US008307618B2

(12) United States Patent
Iwasa et al.

(10) Patent No.: US 8,307,618 B2
(45) Date of Patent: Nov. 13, 2012

(54) PACKAGING APPARATUS

(75) Inventors: Seisaku Iwasa, Shiga (JP); Motoki Takayama, Shiga (JP); Tatsuya Arimatsu, Shiga (JP); Yuji Yokota, Shiga (JP); Takashi Kondo, Hayward, CA (US)

(73) Assignee: Ishida Co., Ltd., Kyoto (JP)

( * ) Notice: Subject to any disclaimer, the term of this patent is extended or adjusted under 35 U.S.C. 154(b) by 403 days.

(21) Appl. No.: 12/694,822

(22) Filed: Jan. 27, 2010

(65) Prior Publication Data

US 2010/0205913 A1 Aug. 19, 2010

Related U.S. Application Data

(60) Provisional application No. 61/229,889, filed on Jul. 30, 2009.

(30) Foreign Application Priority Data

Feb. 16, 2009 (JP) ..... 2009-032826

(51) Int. Cl.
*B65B 35/44* (2006.01)

(52) U.S. Cl. ..... 53/531; 53/443; 53/153; 53/244; 53/282

(58) Field of Classification Search ..... 53/443, 53/448, 475, 153, 531, 537, 542, 543, 244, 53/247, 249, 250, 282; 198/418.6, 418.7, 198/418.9, 419.1, 426
See application file for complete search history.

(56) References Cited

U.S. PATENT DOCUMENTS

| | | | | |
|---|---|---|---|---|
| 4,162,870 | A * | 7/1979 | Storm | 414/798.5 |
| 4,398,383 | A * | 8/1983 | Prakken | 53/537 |
| 4,704,841 | A * | 11/1987 | Langenbeck | 53/448 |
| 4,864,801 | A * | 9/1989 | Fallas | 53/446 |
| 5,052,166 | A * | 10/1991 | Ziegler et al. | 53/433 |
| 5,768,856 | A * | 6/1998 | Odenthal | 53/443 |
| 7,021,450 | B2 * | 4/2006 | Jones, Jr. | 198/462.1 |
| 7,066,317 | B2 * | 6/2006 | Iwasa et al. | 198/431 |
| 7,213,386 | B2 * | 5/2007 | Hooper | 53/448 |
| 7,475,768 | B2 | 1/2009 | Takaoka et al. | |
| 2005/0189197 | A1 * | 9/2005 | Iwasa et al. | 198/431 |
| 2007/0256909 | A1 * | 11/2007 | Shimomae et al. | 198/407 |
| 2010/0170196 | A1 * | 7/2010 | Iwasa et al. | 53/391 |
| 2011/0232228 | A1 * | 9/2011 | Iwasa et al. | 53/147 |

FOREIGN PATENT DOCUMENTS

| | | | |
|---|---|---|---|
| DE | 29600871 | U1 | 3/1996 |
| GB | 1152333 | A | 5/1969 |
| JP | 6-8913 | A | 1/1994 |
| JP | 7-76322 | A | 3/1995 |
| JP | 8-85513 | A | 4/1996 |

* cited by examiner

*Primary Examiner* — Hemant M Desai
(74) *Attorney, Agent, or Firm* — Global IP Counselors, LLP

(57) ABSTRACT

A packaging apparatus includes a conveyance unit having first and second position control plates. The first position control plate is arranged to selectively move forward or backward so as to obstruct or pass the group of packaged objects conveyed on the conveyance unit. When positions of the packaged objects are adjusted, the second position control plate is arranged to move from a downstream-side portion of the conveyance unit toward the first position control plate, rotate in a direction toward the first position control plate. or move from the downstream-side portion of the conveyance unit toward the first position control plate and simultaneously rotate in the direction toward the first position control plate. A subsequent process step delivery unit is arranged to deliver the group of packaged objects after the positions thereof are adjusted by the first and second position control plates, to a subsequent process device.

12 Claims, 19 Drawing Sheets

PACKAGING APPARATUS

CROSS-REFERENCE TO RELATED APPLICATIONS

This application claims priority to Japanese Patent Application No. 2009-032826 filed on Feb. 16, 2009 and U.S. Provisional Application No. 61/229,889 filed on Jul. 30, 2009. The entire disclosures of Japanese Patent Application No. 2009-032826 and U.S. Provisional Application No. 61/229,889 are hereby incorporated herein by reference.

BACKGROUND OF THE INVENTION

1. Field of the Invention

The present invention relates to a packaging apparatus for packing packaged objects in boxes, and more particularly to a packaging apparatus for packing objects packaged by using a thin flexible material.

2. Description of the Background Art

Conventionally, various packaging apparatuses for packing packaged objects in boxes are used. For example, an apparatus is known which suctions packaged objects by using a vacuum suction device, moves the packaged objects, and packs the packaged objects in boxes. However, when the vacuum suction device is used, a portion to be suctioned needs to be flat. Therefore, in order to continuously overlay the packaged objects on adjacent packaged objects, the packaged objects are manually handled, which reduces a working efficiency.

Japanese Laid-Open Patent Publication No. 06-008913 (hereinafter, referred to as Patent Document 1) discloses an objects-packaged-in-bags half-overlaying method for continuously half-overlaying at least two objects packaged in bags on adjacent objects packaged in bags assuredly without causing any great misalignment.

In the objects-packaged-in-bags half-overlaying method disclosed in Patent Document 1, objects packaged in bags are delivered, from a shuttle belt conveyor device in which the length of a belt conveyance plane can be changed by the position of the downstream-side end edge of a conveyor belt being changed, to a reception belt conveyor device which is positioned lower than the shuttle belt conveyor device by a predetermined height, and thus at least two objects packaged in bags are half-overlaid on adjacent objects packaged in bags on the reception belt conveyor device such that each of the objects packaged in the bags is half-overlaid on the immediately preceding one of the objects packaged in the bags, and are conveyed. In the objects-packaged-in-bags half-overlaying method disclosed in Patent Document 1, when the objects packaged in the bags are conveyed by the shuttle belt conveyor device, the shuttle belt conveyor device is driven to operate such that the belt conveyance plane of the shuttle belt conveyor device is elongated, and the downstream-side end edge of the belt conveyance plane is caused to project above the reception belt conveyor device. In a case where the objects packaged in the bags are caused to fall and are delivered from the shuttle belt conveyor device to the reception belt conveyor device, at a time when each of the objects packaged in the bags has been moved to such a position that almost half the length of each of the objects packaged in the bags projects from the downstream-side end edge of the shuttle belt conveyor device, each of the objects packaged in the bags is caused to engage against a stopper provided ahead in the conveying direction, and to stop. Further, the shuttle belt conveyor device stops operating. Subsequently, the conveyor belt of the shuttle belt conveyor device has its downstream-side end edge moved in the upstream direction to shorten the belt conveyance plane, and the stopper is lifted and rotated 90 degrees so as to be distanced from each of the objects packaged in the bags. The reception belt conveyor device incrementally moves to convey the objects packaged in the bags, other than the rearmost one thereof, in increments of a predetermined distance after the falling of each of the objects packaged in the bags such that each of the objects packaged in the bags is half-overlaid on the immediately preceding one of the objects packaged in the bags when each of the objects packaged in the bags falls. After the rearmost one of the objects packaged in the bags falls and is then overlaid on the immediately preceding one of the objects packaged in the bags, the objects packaged in the bags are conveyed and delivered to the immediately following process step.

Japanese Laid-Open Patent Publication No. 07-076322 (hereinafter, referred to as Patent Document 2) discloses a method for packing, in corrugated cardboard boxes, objects packaged in bags so as to be partially overlaid on adjacent objects packaged in bags. In the method, the objects packaged in the bags, which are conveyed at predetermined intervals, are packed, at a high speed, in the corrugated cardboard boxes, so as to be partially overlaid on adjacent objects packaged in bags.

In the method, disclosed in Patent Document 2, for packing, in corrugated cardboard boxes, objects packaged in bags so as to be partially overlaid on adjacent objects packaged in bags, a shuttle belt conveyor having an extendable conveyor downstream-side end portion conveys objects packaged in bags, and incrementally extends or retracts the conveyor downstream-side end portion each time one of the objects packaged in the bags falls, so as to allow a predetermined number of the objects packaged in the bags to continuously fall onto a laterally movable belt conveyor, which is in a non-operating state. Each of the predetermined number of the objects packaged in the bags is received so as to have its falling front portion raised by the laterally movable belt conveyor and a laterally feeding guide and to position each of the predetermined number of the objects packaged in the bags close to the adjacent one thereof. Subsequently, the laterally movable belt conveyor is driven to push and move the objects packaged in the bags to a corrugated multi-tray, by using a laterally feeding component of a conveyor belt, one by one in the order in which the objects packaged in the bags have fallen. Alternatively, the laterally movable belt conveyor may be driven to collectively push and move the objects packaged in the bags to the corrugated multi-tray by using a laterally feeding component of the conveyor belt. Thereafter, the laterally movable belt conveyor is driven to stop operating. All the objects packaged in the bags on the corrugated multi-tray are separately suctioned and held by a necessary number of vacuum pads. Thereafter, the distance between each vacuum pad is shortened, such that the objects packaged in the bags are partially overlaid on adjacent objects packaged in bags continuously. Thus, the objects packaged in the bags are packed in corrugated cardboard boxes.

Further, Japanese Laid-Open Patent Publication No. 08-85513 (hereinafter, referred to as Patent Document 3) discloses an object-packaged-in-bag raising aligning apparatus which is low-cost, and is capable of continuously collecting, at a high speed, a plurality of objects packaged in bags, which are conveyed by a belt conveyor such that the thickness direction thereof corresponds to the horizontal direction.

The object-packaged-in-bag raising aligning apparatus disclosed in Patent Document 3 is provided with: a belt conveyor which constantly operates and can convey objects packaged in bags which are fed onto a conveyor belt; a stopper for stopping a foremost first object packaged in a bag which is conveyed by the belt conveyor; and at least two object-packaged-in-bag raising plates, that is, a first object-packaged-in-bag raising plate and a second object-packaged-in-bag raising plate. The first object-packaged-in-bag raising plate is operable to shake and raise the foremost first object packaged in the bag from its upstream side, by using an air cylinder that is provided below the foremost first object packaged in the bag, which is stopped on the belt conveyor by the stopper, and that operates based on a detection signal from a first object-packaged-in-bag detector for detecting for the foremost first object packaged in the bag, which has been stopped by the stopper, such that the thickness direction thereof almost corresponds to the horizontal direction, and operable to sandwich the foremost first object packaged in the bag between the stopper and the first object-packaged-in-bag raising plate. The second object-packaged-in-bag raising plate is operable to shake and raise a second object packaged in a bag from its upstream side, by using an air cylinder that is provided below the second object packaged in the bag, which immediately follows the foremost first object packaged in the bag and is stopped on the belt conveyor by the first object-packaged-in-bag raising plate, and that operates based on a detection signal from a second object-packaged-in-bag detector for detecting for the second object packaged in the bag, which has been stopped by the first object-packaged-in-bag raising plate, such that the thickness direction thereof almost corresponds to the horizontal direction, and operable to sandwich the second object packaged in the bag between the first object-packaged-in-bag raising plate and the second object-packaged-in-bag raising plate.

SUMMARY OF THE INVENTION

In the objects-packaged-in-bags half-overlaying method as disclosed in Patent Document 1, and the method for packing, in corrugated cardboard boxes, objects packaged in bags so as to be partially overlaid on adjacent objects packaged in bags as disclosed in Patent Document 2, a shuttle conveyor is used to partially overlay objects packaged in bags on adjacent objects packaged in bags.

However, if it is necessary to convey a large number of packaged objects and to align the positions of the large number of packaged objects, the number of packaged objects which can be packed in boxes in a reduced time period in the above-described methods is limited, which is unfavorable.

On the other hand, the object-packaged-in-bag raising aligning apparatus as disclosed in Patent Document 3 cannot increase a processing speed when the number of packaged objects is increased. This is also unfavorable.

An object of the present invention is to provide a packaging apparatus capable of adjusting positions of a large number of articles in a reduced time period, and controlling the positions of packaged objects so as to efficiently pack the packaged objects.

(1) A first aspect of the present invention is directed to a packaging apparatus which includes: a collection unit for overlaying a plurality of packaged objects on adjacent packaged objects; and a conveyance unit for conveying the plurality of packaged objects which are overlaid on the adjacent packaged objects at the collection unit. In the packaging apparatus, the conveyance unit includes a first position control plate, a second position control plate, and a subsequent process step delivery unit, and the first position control plate moves forward or backward so as to obstruct or pass the plurality of packaged objects conveyed on the conveyance unit. Further, when positions of the plurality of packaged objects are adjusted, the second position control plate starts to be moved from a downstream-side portion of the conveyance unit toward the first position control plate, or starts to be rotated in a direction toward the first position control plate, or starts to be moved from the downstream-side portion of the conveyance unit toward the first position control plate and simultaneously starts to be rotated in the direction toward the first position control plate. Moreover, the subsequent process step delivery unit is operable to deliver the plurality of packaged objects having the positions adjusted by the first position control plate and the second position control plate, to a process step for packing the plurality of packaged objects in a box.

In the packaging apparatus according to the present invention, a plurality of packaged objects are overlaid on adjacent packaged objects at the collection portion, and the plurality of packaged objects overlaid on the adjacent packaged objects are conveyed by the conveyance unit. The conveyance unit includes the first position control plate, the second position control plate, and the subsequent process step delivery unit. The first position control plate moves forward or backward so as to obstruct or pass the plurality of packaged objects. When the positions of the plurality of packaged objects are adjusted, the second position control plate starts to be moved from a downstream-side portion of the conveyance unit toward the first position control plate, or starts to be rotated in a direction toward the first position control plate, or starts to be moved from the downstream-side portion of the conveyance unit toward the first position control plate and simultaneously starts to be rotated in the direction toward the first position control plate. The subsequent process step delivery unit is operable to deliver the plurality of packaged objects having the positions adjusted by the first position control plate and the second position control plate, to a process step for packing the plurality of packaged objects in a box.

In this case, when the first position control plate moves so as to obstruct the movement of the packaged objects, the second position control plate starts to be moved toward the first position control plate, or starts to be rotated in a direction toward the first position control plate, or starts to be moved toward the first position control plate and simultaneously starts to be rotated in the direction toward the first position control plate, thereby enabling positions of the plurality of packaged objects to be adjusted. The subsequent process step delivery unit is operable to deliver the plurality of packaged objects having the positions adjusted by the first position control plate and the second position control plate, to a process step for packing the plurality of packaged objects in a box.

Therefore, the packaging apparatus according to the present invention allows positions of a large number of articles to be simultaneously adjusted. That is, it is possible to align a large number of packaged objects and pack the large number of packaged objects in a box in a reduced time period.

(2) The conveyance unit is formed as an extendable belt conveyor. The second position control plate is formed as a plate component. The second position control plate is pivotally supported by the extendable belt conveyor at a downstream-side end edge portion of the extendable belt conveyor, and pivots about the downstream-side end edge portion of the extendable belt conveyor when the extendable belt conveyor is extended or retracted.

In this case, the conveyance unit is formed as an extendable belt conveyor, and the second position control plate is pivotally supported at the downstream-side end edge portion of the extendable belt conveyor. Therefore, when the positions of the packaged objects are aligned, the extendable belt conveyor is moved so as to be retracted in the retracting direction in which the extendable belt conveyor is to be retracted, and the second position control plate is moved in the retracting direction, and is simultaneously rotated. Alternatively, when the positions of the packaged objects are aligned, the extendable belt conveyor is moved in the retracting direction, and the second position control plate starts to be rotated during a period in which the second position control plate is being moved in the retracting direction. Therefore, the positions of the packaged objects can be adjusted in a reduced time period.

(3) The second position control plate may be configured such that, before the packaged objects are aligned, a pivotally supported end edge of the plate component is positioned vertically below a conveyance plane of the extendable belt conveyor.

In this case, before the packaged objects are aligned, a pivotally supported end edge of the plate component is positioned vertically below a conveyance plane of the extendable belt conveyor. Therefore, when the packaged objects being conveyed on the extendable belt conveyor are conveyed to the second position control plate, the head portion of any one of the packaged objects is prevented from being inserted into a clearance between the end edge of the plate component of the second position control plate and the conveyance plane of the extendable belt conveyor.

(4) The packaging apparatus further includes a control unit for controlling the conveyance unit and the second position control plate. In the packaging apparatus, the second position control plate is pivotally supported at a downstream-side portion of the conveyance unit, and controls positions of the plurality of packaged objects. Further, the control unit performs a control so as to increase a relative distance between a shaft of the second position control plate and a second packaged object among the group of packaged objects while erecting the second position control plate.

In this case, the control unit performs a control so as to increase a relative distance between a shaft of the second position control plate and a second packaged object among the group of packaged objects while erecting the second position control plate. Therefore, it is possible to form a space for allowing a position of the first packaged object to be adjusted, and to adjust the position of the first packaged object by using the second position control plate. Consequently, the group of packaged objects can be conveyed in the standing position.

(5) The control unit may perform the control so as to increase the relative distance between the shaft of the second position control plate and the second packaged object among the group of packaged objects by the shaft of the second position control plate being moved toward the downstream-side portion of the conveyance unit.

In this case, the control unit may perform the control so as to increase the relative distance between the shaft of the second position control plate and the second packaged object among the group of packaged objects by the shaft of the second position control plate being moved toward the downstream-side portion of the conveyance unit. Specifically, when the shaft of the second position control plate is moved toward the downstream side, it is possible to form a space for allowing the position of the first packaged object to be adjusted, and to adjust the position of the first packaged object by using the second position control plate. Consequently, the group of packaged objects can be conveyed in the standing position.

(6) The control unit may perform the control so as to increase the relative distance between the shaft of the second position control plate and the second packaged object among the group of packaged objects by a conveyance plane of the conveyance unit being moved in a direction opposite to a conveying direction in which the group of packaged objects is conveyed.

In this case, the control unit may perform the control so as to increase the relative distance between the shaft of the second position control plate and the second packaged object among the group of packaged objects by a conveyance plane of the conveyance unit being moved in a direction opposite to a conveying direction. Specifically, when the conveyance plane is moved in the direction opposite to the conveying direction, the second packaged object can be moved. Therefore, it is possible to form a space for allowing the position of the first packaged object to be adjusted, and to adjust the position of the first packaged object by using the second position control plate. Consequently, the group of packaged objects can be conveyed in the standing position.

(7) The control unit may perform a control such that the shaft of the second position control plate is moved close to the second packaged object among the group of packaged objects while the second position control plate is approaching a horizontal position, and thereafter the second position control plate is rotated to be erected.

In this case, the control unit performs a control such that the shaft of the second position control plate is moved close to the second packaged object among the group of packaged objects while the second position control plate is approaching a horizontal position, and thereafter the second position control plate is rotated to be erected. Therefore, even when the first packaged object fails to enter the standing position, the second position control plate is caused to approach the horizontal position so as to lift and stand the first packaged object again, so that the position of the first packaged object is assuredly adjusted by using the second position control plate. Consequently, the group of packaged objects can be conveyed in the standing position.

(8) The control unit may perform a control such that the second position control plate is rotated so as to be erected while the shaft of the second position control plate is being moved toward an upstream side.

In this case, the control unit performs a control such that the second position control plate is rotated so as to be erected while the shaft of the second position control plate is being moved toward an upstream side. Therefore, the second position control plate approaches the bottom of the first packaged object, and the first packaged object is lifted and is simultaneously rotated. Consequently, the first packaged object can easily enter the standing position.

(9) The control unit may perform a control such that a distance between the shaft of the second position control plate and the second packaged object is changed so as to maintain the second position control plate erected.

In this case, the control unit performs a control such that a distance between the shaft of the second position control plate and the second packaged object is changed so as to maintain the second position control plate erected. Therefore, the group of packaged objects can be appropriately compressed or released. Accordingly, even when one or more of the packaged objects among the group of packaged objects are lifted off the conveyance plane, the lifted packaged object is allowed to contact the conveyance plane in the standing position by the group of packaged objects being compressed or released.

(10) The control unit may perform a control in which, when the second position control plate waits for the group of packaged objects being conveyed, the second position control plate is moved such that the greater a distance from a downstream end edge of the conveyance unit to the first position control plate is, the more upwardly the second position control plate is tilted relative to a conveyance plane.

Thus, the second position control plate waits for the group of packaged objects in a state in which the second position control plate is tilted upward. Therefore, when the packaged objects are conveyed, the movement of the packaged objects in the conveying direction can be attenuated, and an angle by which the first packaged object is to be rotated is reduced, so that the position of the first packaged object among the group of packaged objects can be adjusted in a reduced time period.

(11) The first position control plate is operable to move forward or backward in a direction orthogonal to a conveying direction in which the conveyance unit conveys the group of packaged objects, so as to obstruct or pass the group of packaged objects being conveyed. The control unit may control the conveyance unit such that the group of packaged objects passes the first position control plate, and, after the group of packaged objects has passed the first position control plate, the control unit controls the first position control plate so as to move forward such that a force is applied to the group of packaged objects, from both the conveying direction and a direction opposite to the conveying direction, by means of both the first position control plate and the second position control plate.

In this case, when the group of packaged objects being conveyed on the conveyance plane of the conveyance unit passes the first position control plate, the control unit controls the first position control plate so as to move forward, and controls the second position control plate so as to be rotated and moved toward the first position control plate. Consequently, a force is applied to the group of packaged objects from both the conveying direction and a direction opposite to the conveying direction. In this case, the position of the group of packaged objects can be aligned, and then delivered to the subsequent process step.

(12) The conveyance unit may include a belt conveyor which is extendable at a downstream-side end portion thereof along a conveying direction in which the group of packaged objects is conveyed, and the shaft of the second position control plate may be provided at the downstream-side end portion of the belt conveyor which is extendable.

In this case, the conveyance unit is formed as a belt conveyor which is extendable along the conveying direction. Therefore, when the belt conveyer is extended, the shaft of the second position control plate can be moved.

The packaging apparatus according to the present invention is capable of controlling packaged objects such that the packaged objects are aligned in such positions as to be efficiently packed.

DESCRIPTION OF THE PREFERRED EMBODIMENTS

Hereinafter, embodiments of the present invention will be described with reference to the drawings. In the embodiments of the present invention, a packaging apparatus which overlays deformable packaged objects on adjacent packaged objects will be described by using specific examples. In the embodiments of the present invention, an exemplary case where a plurality of packaged objects 110*a*, 110*b*, 110*c*, 110*d*, and 110*e* are conveyed as a group of packaged objects 110 will be described. In the embodiments of the present invention, an exemplary case where packaged objects having deformable shapes are handled is described. However, the packaging apparatus of the present invention is applicable to packaged objects having box-like shapes, and any other packaged objects.

First Embodiment

Figure 1:
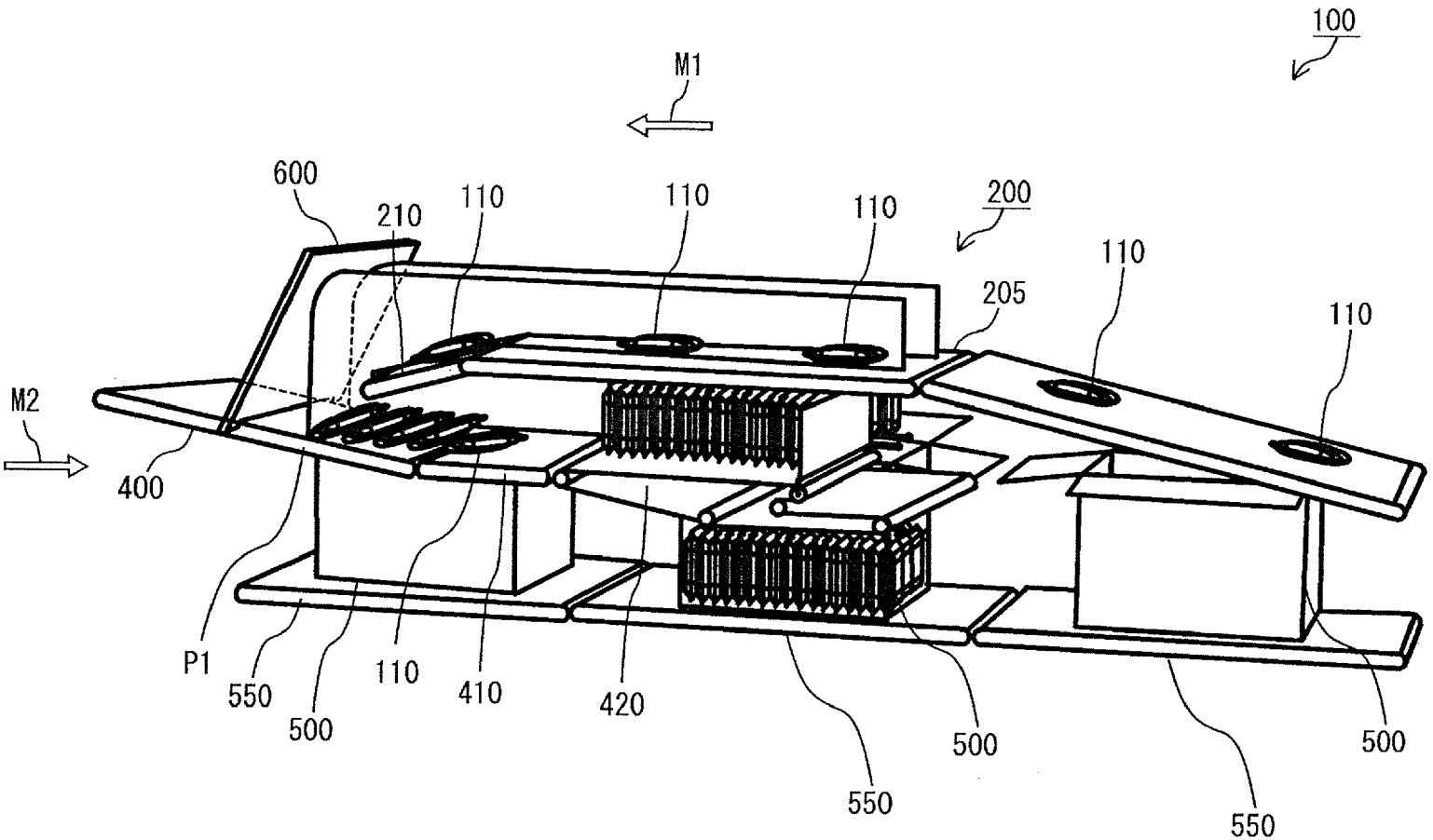
FIG. 1 is a schematic diagram illustrating an exemplary external appearance of a packaging apparatus according to a first embodiment of the present invention.

FIG. 1 is a schematic diagram illustrating an exemplary external appearance of a packaging apparatus 100 according to a first embodiment of the present invention.

The packaging apparatus 100 shown in FIG. 1 mainly includes: a first conveyance unit 200; a second conveyance unit 400; a third conveyance unit 410; an extendable conveyance unit 420; a box conveyance unit 550; and a rotation prevention guide unit 600. The first conveyance unit 200, the second conveyance unit 400, the third conveyance unit 410, and the extendable conveyance unit 420 are each formed as a conveyance structure having an endless belt conveyor. Further, the extendable conveyance unit 420 is configured as an extendable belt conveyor such as a shuttle conveyor. An operation performed by the extendable conveyance unit 420 will be described below in detail.

The first conveyance unit 200 moves a plurality of packaged objects 110 in the direction indicated by an arrow M1. The first conveyance unit 200 includes a horizontal unit 205 and a tilt unit 210. The tilt unit 210 is provided immediately following the horizontal unit 205.

Below the first conveyance unit 200, the second conveyance unit 400, the third conveyance unit 410, and the extendable conveyance unit 420 are provided. The second conveyance unit 400, the third conveyance unit 410, and the extendable conveyance unit 420 move the plurality of packaged objects 110 in the direction which is indicated by an arrow M2 and is opposite to the direction indicated by the arrow M1. The second conveyance unit 400 is provided so as to be tilted at a tilt angle $\alpha 2$ relative to the horizontal plane (see FIG. 3).

In this case, since the second conveyance unit 400 is provided so as to be tilted at the angle $\alpha 2$, when a predetermined number of the packaged objects 110 are conveyed toward the downstream, even if the conveyance speed is rapidly increased, positions of packaged objects, among the packaged objects 110, aligned on the downstream side are prevented from being reversed, and the positions remain unchanged, thereby stably conveying the predetermined number of the packaged objects. The second conveyance unit 400 includes a reception portion P1 for receiving the packaged objects 110 which are moved from the tilt unit 210 of the first conveyance unit 200, and a collection portion AR1 (see FIG. 4) for collecting the received packaged objects so as to be overlaid on adjacent received packaged objects.

As shown in FIG. 1, the plurality of packaged objects 110 are moved on the horizontal unit 205 of the first conveyance unit 200, and then moved on the tilt unit 210 of the first conveyance unit 200, and are collected, as a group of packaged objects, at the collection portion AR1 of the second conveyance unit 400.

The group of packaged objects is aligned in a standing position as described below, and is pushed out in the far direction in FIG. 1. Thereafter, the group of packaged objects is moved from above a box 500 into the box 500 positioned therebelow. The box 500 is moved in the direction indicated by the arrow M2 by the box conveyance unit 550, and is sealed by a sealing device (not shown), thereby completing an operation for packing the group of packaged objects in a box.

Preferably, an apparatus for unfolding and sealing a corrugated cardboard to form the box 500, which is not shown in FIG. 1, is separately provided. The box 500 is moved by the box conveyance unit 550 in the present embodiment. However, the present invention is not limited thereto. The box 500 may be moved by another device. Further, in the present embodiment, the packaged objects are caused to fall from above the box 500, and are packed in a box. However, the present invention is not limited thereto. An opening may be provided on the side portion of the box 500, and the plurality of packaged objects may be slid into the box 500 therethrough, and are packed.

Figure 2:
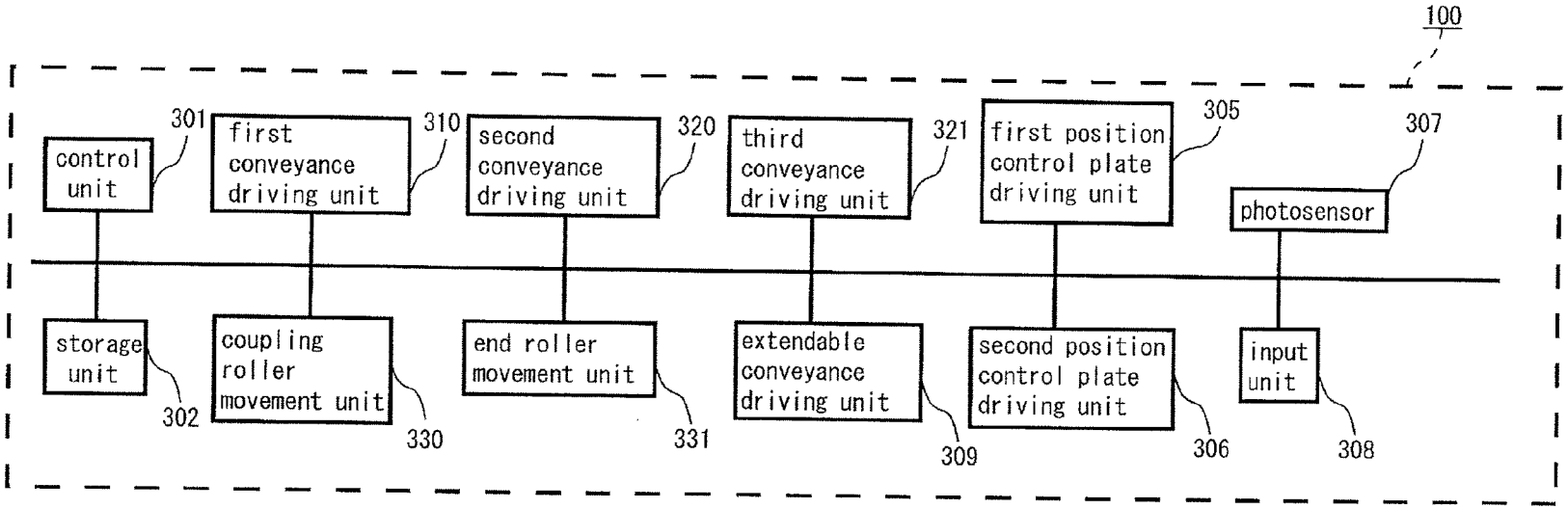
FIG. 2 is a schematic structure diagram illustrating main components of the packaging apparatus.

Next, FIG. 2 is a schematic structure diagram illustrating main components of the packaging apparatus 100.

As shown in FIG. 2, the packaging apparatus 100 includes: a control unit 301; a storage unit 302; a first position control plate driving unit 305; a second position control plate driving unit 306; a photosensor 307; an input unit 308; an extendable conveyance driving unit 309; a first conveyance driving unit 310; a second conveyance driving unit 320; a third conveyance driving unit 321; a coupling roller movement unit 330; and an end roller movement unit 331. The photosensor 307 is a detection device which detects whether or not each packaged object has passed.

Based on article data, of the plurality of packaged objects, which is inputted through the input unit 308, the control unit 301 selects a control program which corresponds to the article data and is stored in the storage unit 302. The control program stored in the storage unit 302 is loaded into the control unit 301, and the control unit 301 controls, based on a signal from the photosensor 307, an operation of each of the first conveyance driving unit 310, the second conveyance driving unit 320, the third conveyance driving unit 321, the first position control plate driving unit 305, the second position control plate driving unit 306, and the extendable conveyance driving unit 309.

The first conveyance driving unit 310 controls operations of the horizontal unit 205 and the tilt unit 210. The second conveyance driving unit 320 controls an operation of the second conveyance unit 400. The third conveyance driving unit 321 controls an operation of the third conveyance unit 410. The first position control plate driving unit 305 controls an operation of the first position control plate 405. The second position control plate driving unit 306 controls an operation of the second position control plate 406. The extendable conveyance driving unit 309 controls a conveyance operation and an extending and retracting operation of the extendable conveyance unit 420.

Further, the coupling roller movement unit 330 is operable to change the length of the horizontal unit 205 by positions of respective rollers provided between the horizontal unit 205 and the tilt unit 210 being changed. The end roller movement unit 331 is operable to change a tilt angle of the tilt unit 210 by a position of the end roller of the tilt unit 210 of the first conveyance unit 200 being changed.

Next, FIG. 3 to FIG. 7 are schematic side views illustrating outlines of operations performed by the first conveyance unit 200, the second conveyance unit 400, the third conveyance unit 410, and the extendable conveyance unit 420 of the packaging apparatus 100. Hereinafter, a group of packaged objects corresponding to the packaged objects 110 having been collected is represented as a group of packaged objects 110. A first packaged object among the group of packaged objects 110 is represented as a packaged object 110*a*, a second packaged object thereamong is represented as a packaged object 110*b*, a third packaged object thereamong is represented as a packaged object 110*c*, a fourth packaged object thereamong is represented as a packaged object 110*d*, and a fifth packaged object thereamong is represented as a packaged object 110*e*.

Figure 3:
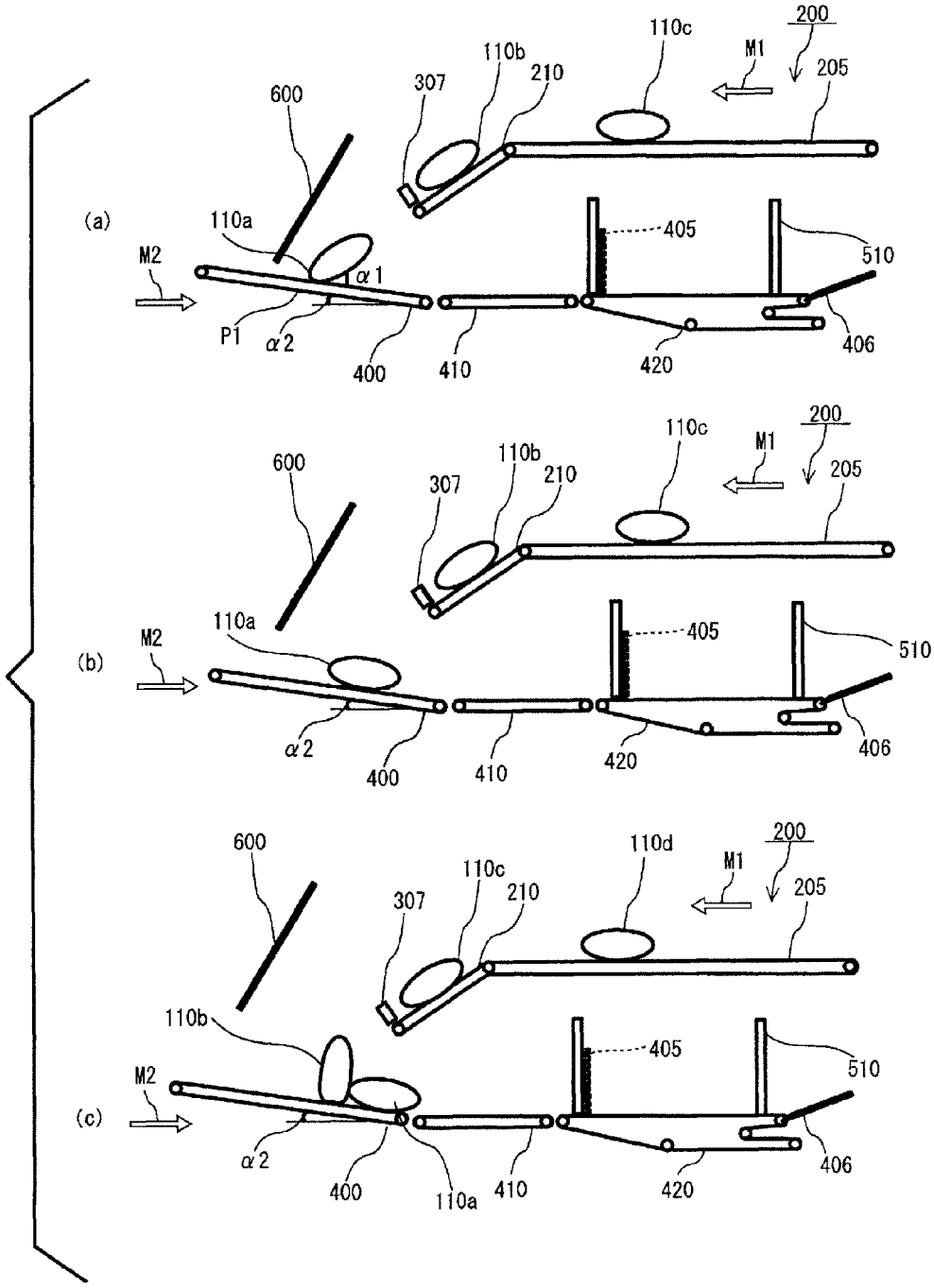
FIG. 3 is a schematic side view showing outlines of operations performed by a first conveyance unit, a second conveyance unit, a third conveyance unit, and an extendable conveyance unit of the packaging apparatus.

Firstly, as shown in FIG. 3(*a*), the packaged object 110*a* is moved from the first conveyance unit 200 onto the reception portion P1 of the second conveyance unit 400. The packaged object 110*a* is received at the reception portion P1 so as to be tilted at an angle α1.

Subsequently, as shown in FIG. 3(*b*), the packaged object 110*a* falls by its own weight, and the second conveyance unit 400 conveys the packaged object 110*a*, by a distance less than the entire length of the packaged object 110*a*, in the direction indicated by the arrow M2.

Subsequently, as shown in FIG. 3(*c*), the second packaged object 110*b* is moved from the first conveyance unit 200 to the second conveyance unit 400. The second packaged object 110*b* contacts the end edge of the immediately preceding first packaged object 110*a*, and enters the standing position. Similarly, as shown in FIG. 4(*d*), the immediately following packaged object 110*c* contacts the end portion of the second packaged object 110*b* at the collection portion AR1 of the second conveyance unit 400, and enters the standing position.

Figure 4:
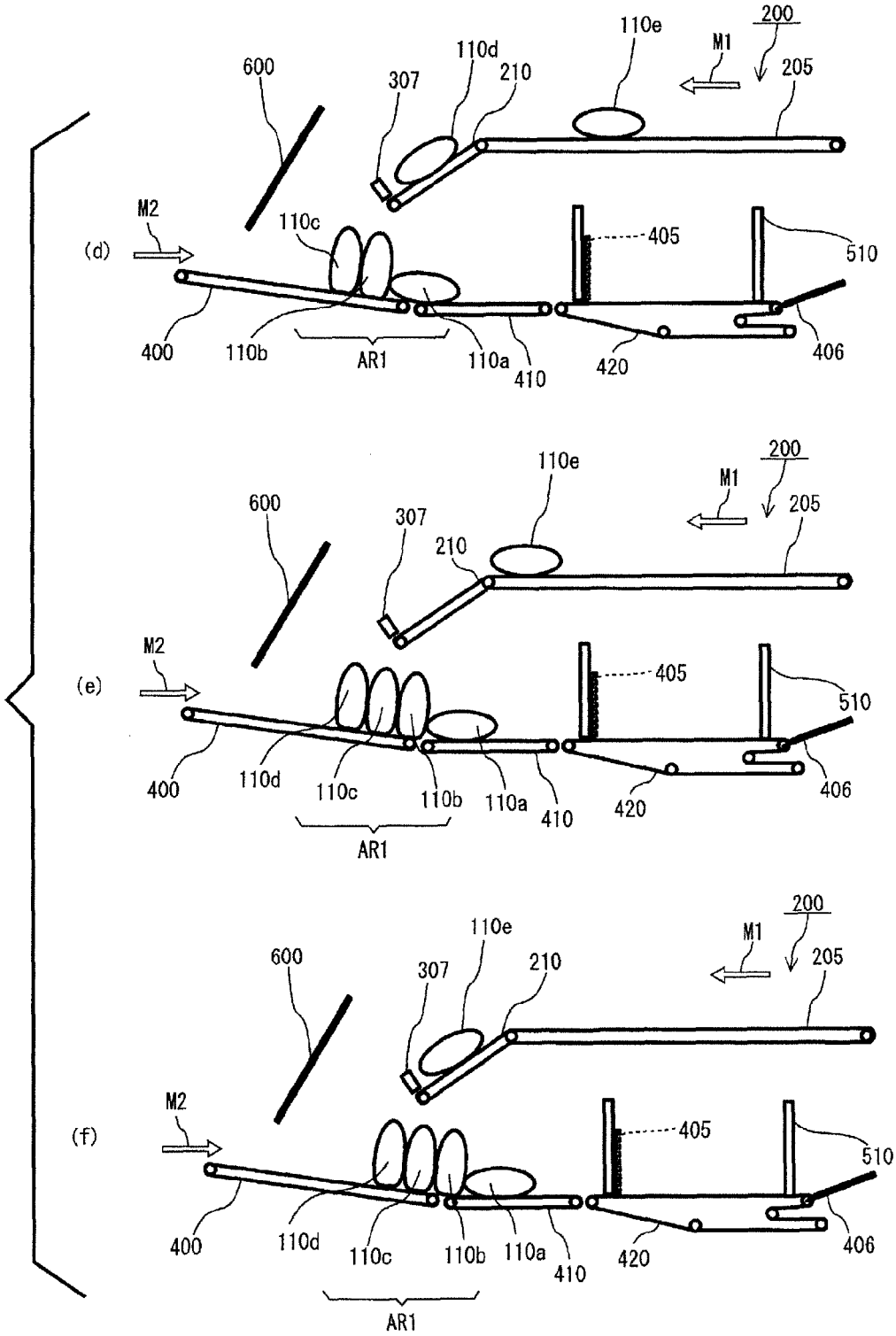
FIG. 4 is a schematic side view showing the outlines of the operations performed by the first conveyance unit, the second conveyance unit, the third conveyance unit, and the extendable conveyance unit of the packaging apparatus.

As shown in FIG. 4(*e*), immediately following the packaged object 110*c*, the packaged object 110*d* is moved to the second conveyance unit 400, and similarly contacts the end portion of the immediately preceding packaged object 110*c* at the collection portion AR1, and enters the standing position. Subsequently, as shown in FIG. 4(*f*), immediately following the packaged object 110*d*, the packaged object 110*e* is moved to the tilt unit 210.

Figure 5:
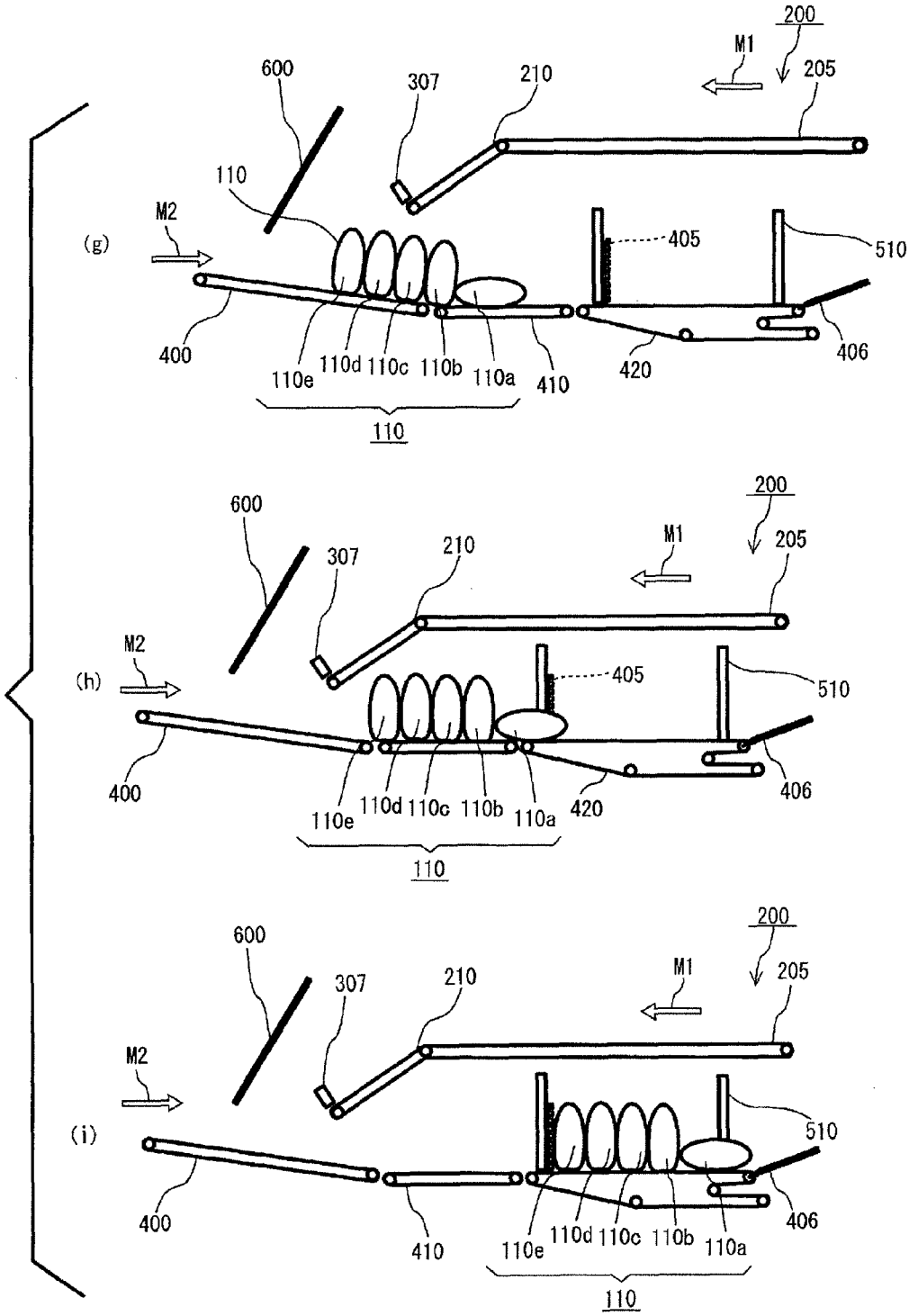
FIG. 5 is a schematic side view showing the outlines of the operations performed by the first conveyance unit, the second conveyance unit, the third conveyance unit, and the extendable conveyance unit of the packaging apparatus.

Subsequently, as shown in FIG. 5(*g*), the packaged object 110*e* is in turn moved. The packaged objects 110*b*, 110*c*, 110*d*, and 110*e*, which are in the standing positions, are collected and held as the group of packaged objects 110 at the collection portion AR1. The control unit 301 controls the speed of the second conveyance unit 400 until the group of packaged objects 110 are collected at the collection portion AR1 of the second conveyance unit 400.

Subsequently, when, as shown in FIG. 5(*h*), the group of packaged objects 110 has been moved to the collection portion AR1 of the second conveyance unit 400, the control unit 301 increases the speeds of the second conveyance unit 400 and the third conveyance unit 410, and the group of packaged objects 110 is conveyed in the direction indicated by the arrow M2. At this time, as shown in FIG. 5(*h*), the group of packaged objects 110 is all loaded on the third conveyance unit 410, and the immediately following group of packaged objects 110 (not shown) is moved from the first conveyance unit 200 to the second conveyance unit 400.

Subsequently, as shown in FIG. 5(*i*), the group of packaged objects 110 is moved from the third conveyance unit 410 to the extendable conveyance unit 420. When the group of packaged objects 110 has been moved to the extendable conveyance unit 420, namely, when the packaged object 110*e* has been moved so as to be subjected to a process step immediately following the first position control plate 405 (in the direction indicated by the arrow M2), the first position control plate 405 enters the extendable conveyance unit 420.

In this case, the second conveyance unit 400 is being driven so as to move in small increments. The second conveyance unit 400 and the third conveyance unit 410 are separately provided. Therefore, the third conveyance unit 410 can be independently driven. Thus, the third conveyance unit 410 can be used as a buffer, and the group of packaged objects 110 can be stocked on the third conveyance unit 410 so as to adjust a time for which each of the first position control plate 405, the second position control plate 406, and the third position control plate 407, which are described below, is driven.

Figure 6:
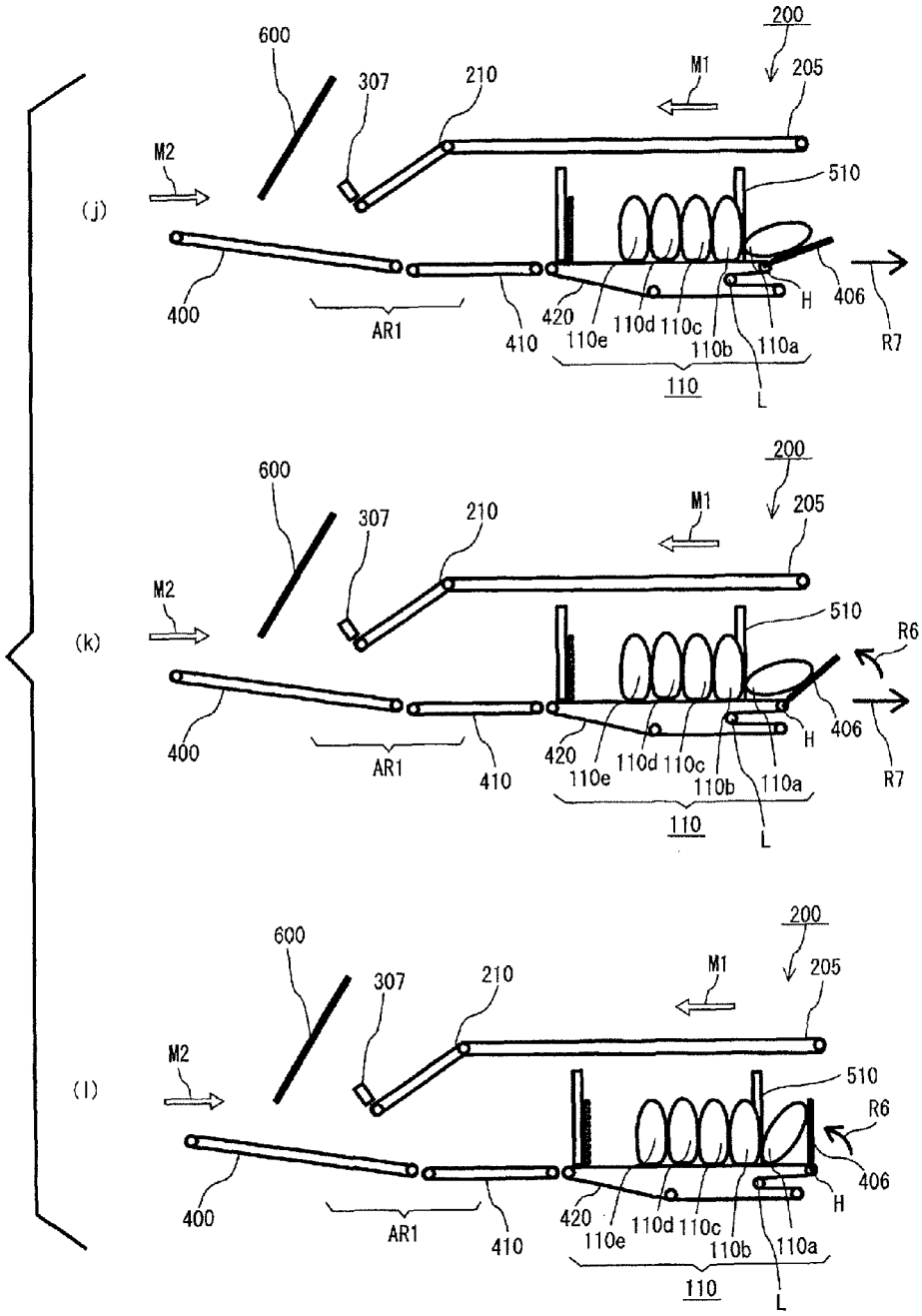
FIG. 6 is a schematic side view showing the outlines of the operations performed by the first conveyance unit, the second conveyance unit, the third conveyance unit, and the extendable conveyance unit of the packaging apparatus.

Subsequently, as shown in FIG. 6(*j*), the first packaged object 110*a* among the group of packaged objects 110 is loaded on the second position control plate 406, and a shaft H of the extendable conveyance unit 420 starts to be moved along the horizontal direction indicated by an arrow R7.

When the shaft H is moved, the control unit 301 performs a control such that the conveyance plane of the extendable conveyance unit 420 does not move in accordance with the movement of the shaft H. Namely, when the shaft H is extended without moving the conveyance plane, the conveyance plane is increased. Therefore, the group of packaged objects 110 is not moved. Further, a shaft L of the extendable conveyance unit 420 is horizontally moved in the direction indicated by the arrow R7.

Subsequently, as shown in FIG. 6(*k*), while the shaft H of the extendable conveyance unit 420 is being moved in the direction indicated by the arrow R7, the second position control plate 406 starts to be rotated in the direction indicated by an arrow R6. In this case, the shaft L of the extendable conveyance unit 420 is further moved in the direction indicated by the arrow R7. The first packaged object 110*a* among the group of packaged objects 110 is supported by the second position control plate 406, thereby approaching the standing position.

Subsequently, as shown in FIG. 6(*l*), the second position control plate 406 is further rotated in the direction indicated by the arrow R6. Thus, the first packaged object 110*a* enters the standing position.

Figure 7:
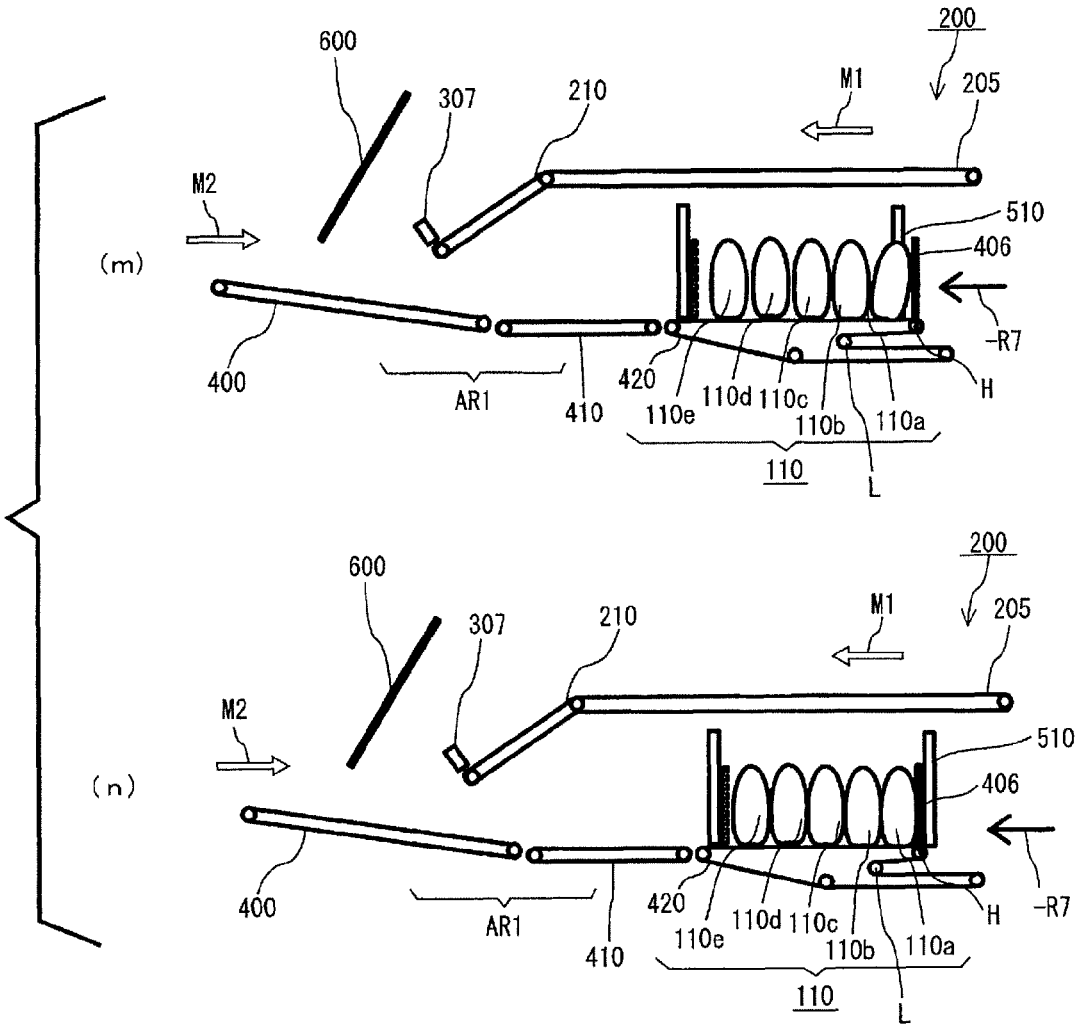
FIG. 7 is a schematic side view showing the outlines of the operations performed by the first conveyance unit, the second conveyance unit, the third conveyance unit, and the extendable conveyance unit of the packaging apparatus.

Subsequently, as shown in FIG. 7(*m*), the second position control plate 406 and the shaft H of the extendable conveyance unit 420 are moved in the direction (the direction opposite to the direction indicated by the arrow R7) indicated by an arrow −R7, thereby compressing the group of packaged objects 110. Lastly, as shown in FIG. 7(*n*), the second position control plate 406 and the shaft H of the extendable conveyance unit 420 are further moved in the direction indicated by the arrow −R7. Thereafter, the group of packaged objects 110 is moved to a packing unit (in the far direction in the drawing) which is used in the immediately following process step.

In FIG. 3 to FIG. 7, the second position control plate 406 waits for the group of packaged objects 110 in a state in which the second position control plate 406 has been slightly rotated from the horizontal position in the direction indicated by the arrow R6. However, the present invention is not limited thereto. The second position control plate 406 may wait for the group of packaged objects 110 in a state in which the second position control plate 406 has been slightly rotated from the horizontal position in the direction opposite to the direction indicated by the arrow R6.

Further, in the present embodiment, the shaft H shown in FIG. 6(*j*) is operated so as to prevent the conveyance plane from moving. However, the present invention is not limited thereto. The conveyance plane may be controlled so as to be moved in the direction indicated by the arrow M2.

Second Embodiment

Next, a packaging apparatus 100 according to a second embodiment will be described. For the packaging apparatus 100 according to the second embodiment, components and operations different from those of the packaging apparatus 100 according to the first embodiment will be mainly described.

Figure 8:
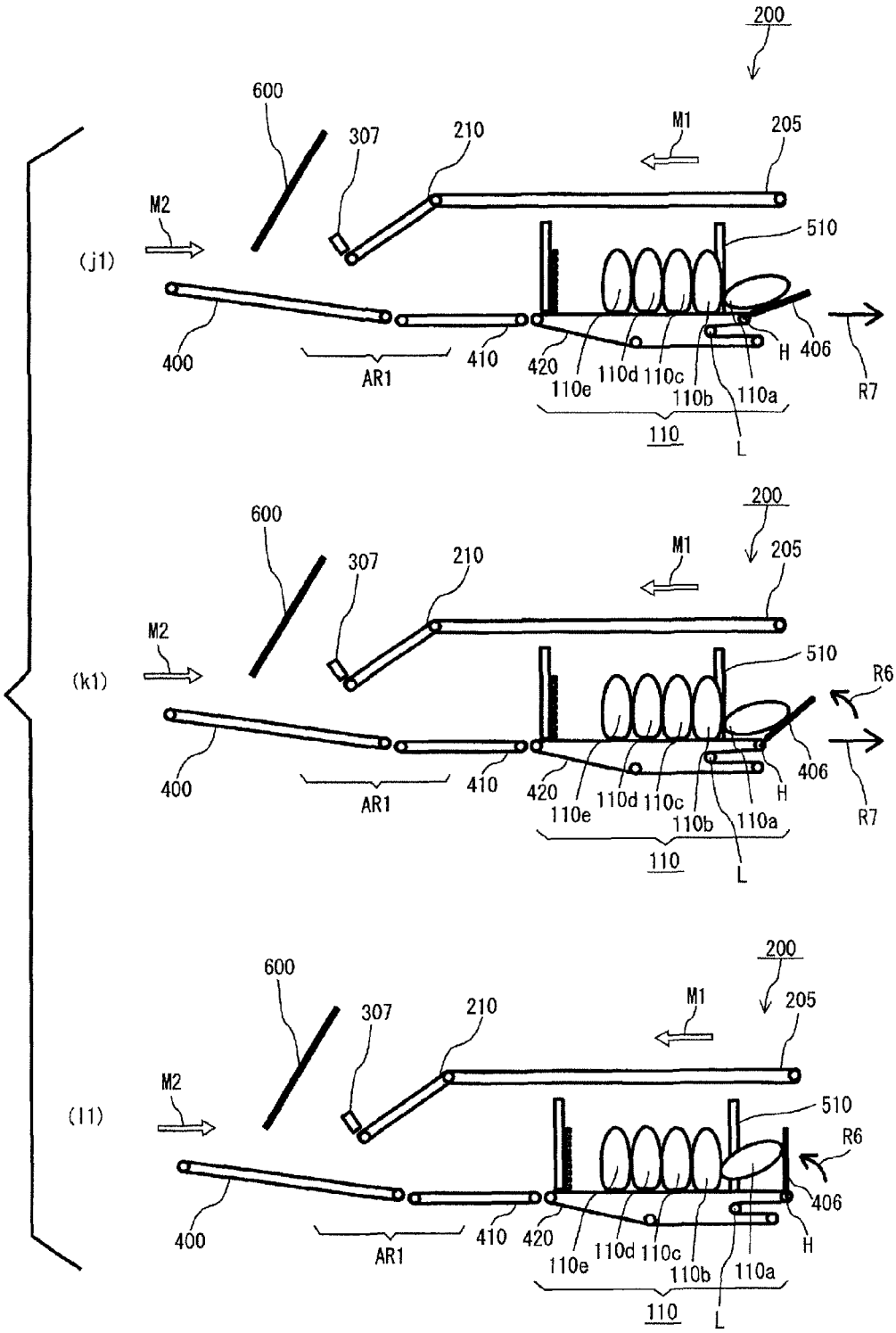
FIG. 8 is a schematic side view showing outlines of operations performed by a first conveyance unit, a second conveyance unit, a third conveyance unit, and an extendable conveyance unit of a packaging apparatus.
Figure 9:
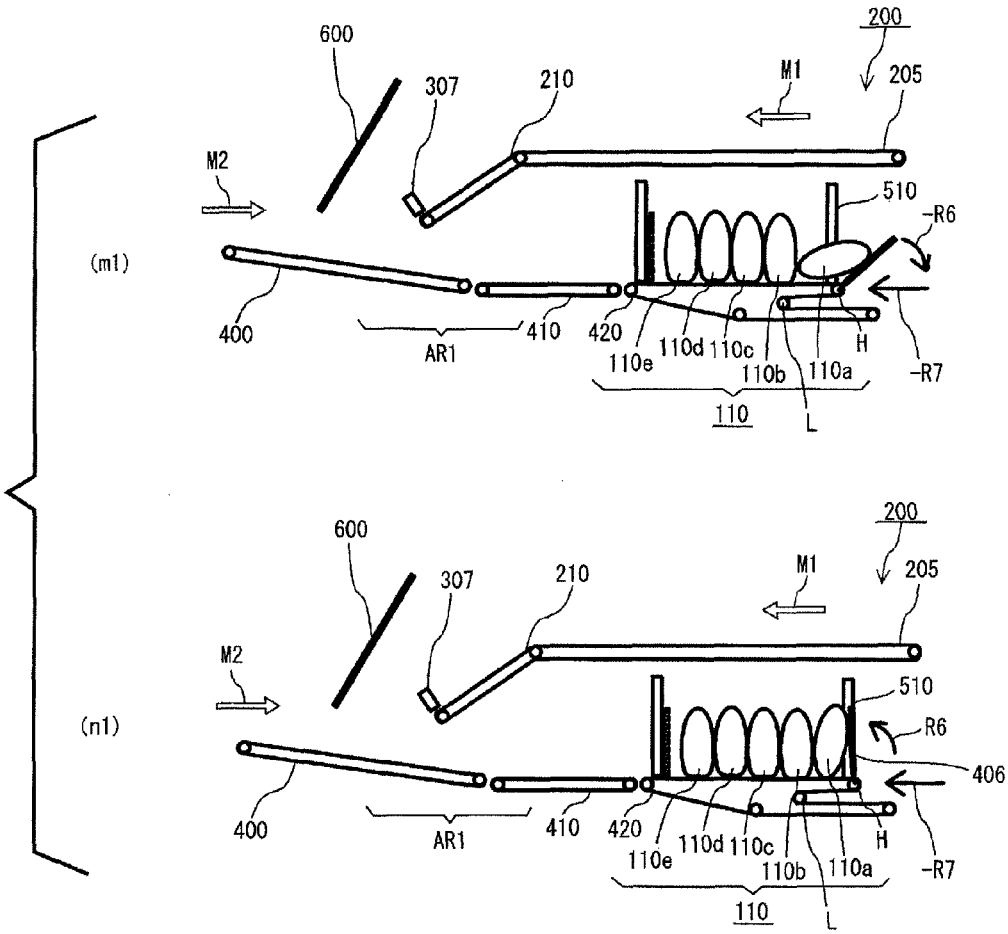
FIG. 9 is a schematic side view showing the outlines of the operations performed by the first conveyance unit, the second conveyance unit, the third conveyance unit, and the extendable conveyance unit of the packaging apparatus.
Figure 10:
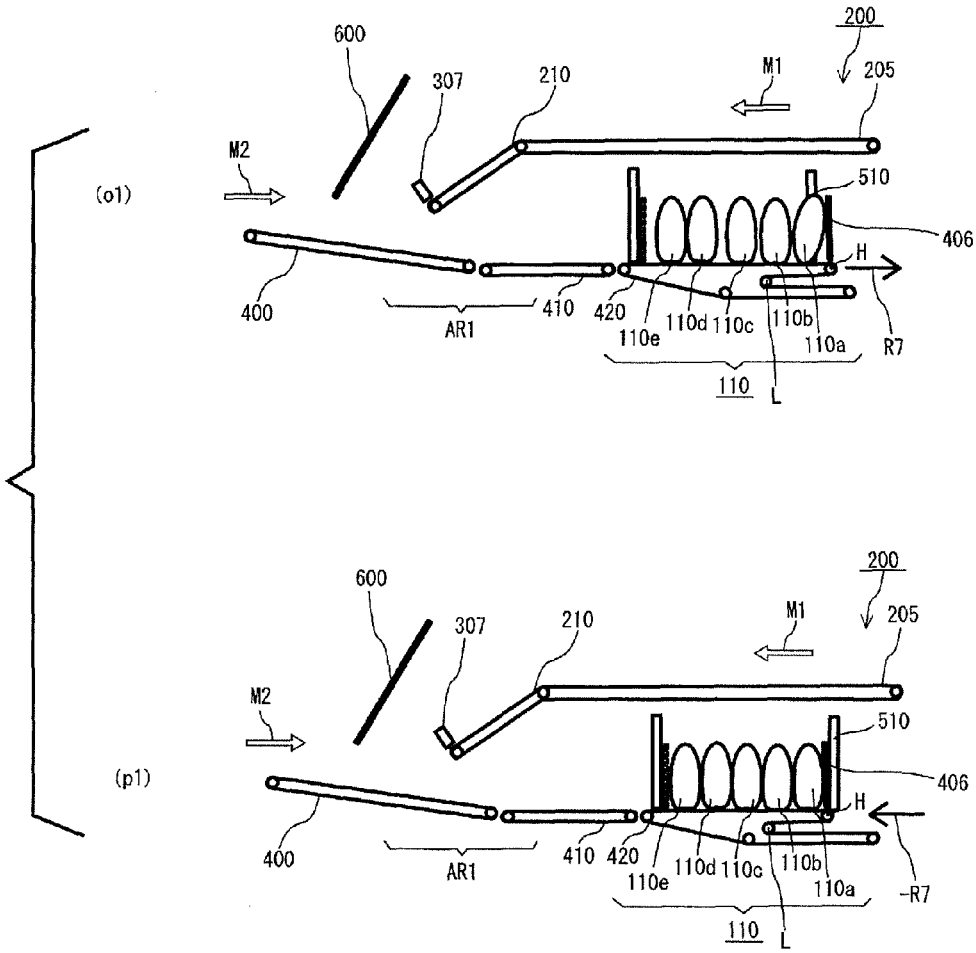
FIG. 10 is a schematic side view showing the outlines of the operations performed by the first conveyance unit, the second conveyance unit, the third conveyance unit, and the extendable conveyance unit of the packaging apparatus.

FIG. 8 to FIG. 10 are schematic side views illustrating outlines of operations performed by a first conveyance unit 200, a second conveyance unit 400, a third conveyance unit 410, and an extendable conveyance unit 420 of the packaging apparatus 100.

The packaging apparatus 100 according to the second embodiment controls the second position control plate 406 in a manner different from the packaging apparatus 100 according to the first embodiment.

The packaging apparatus 100 according to the second embodiment performs the same operations as shown in FIG. 3 to FIG. 5. As shown in FIG. 8(*j*1), a first packaged object 110*a* among the group of packaged objects 110 is loaded on the second position control plate 406, and a shaft H of the extendable conveyance unit 420 starts to be moved along the horizontal direction indicated by an arrow R7.

Subsequently, as shown in FIG. 8(*k*1), while the shaft H of the extendable conveyance unit 420 is being further moved in the direction indicated by the arrow R7, the second position control plate 406 starts to be rotated in the direction indicated by an arrow R6. A shaft L of the extendable conveyance unit 420 is further moved in the direction indicated by the arrow R7. Consequently, the first packaged object 110*a* among the group of packaged objects 110 engages against the second position control plate 406.

Subsequently, as shown in FIG. 8(*l*1), the second position control plate 406 is further rotated in the direction indicated by the arrow R6. At this time, the first packaged object 110*a* does not enter the standing position but is tilted.

Subsequently, as shown in FIG. 9(*m*1), the second position control plate 406 is rotated in the direction (the direction opposite to the direction indicated by the arrow R6) indicated by an arrow −R6, and the shaft H is moved in the direction indicated by an arrow −R7. The second position control plate 406 can be positioned under the bottom of the packaged object 110*a* by the shaft H being moved in the direction indicated by the arrow −R7.

Subsequently, as shown in FIG. 9(*n*1), the second position control plate 406 is rotated in the direction indicated by the arrow R6, and the shaft H is further moved in the direction indicated by the arrow −R7. Thus, the packaged object 110*a* assuredly enters the standing position.

Lastly, as shown in FIG. 10(*o*1), in a state in which the second position control plate 406 is vertically erected, the shaft H is moved, in the direction indicated by the arrow R7, over a distance which is greater than the thickness of each of the packaged objects 110*a*, 110*b*, 110*c*, 110*d*, and 110*e*, and is less than twice the thickness of each of the packaged objects 110*a*, 110*b*, 110*c*, 110*d*, and 110*e*. As shown in FIG. 10(*p*1), in a state in which the second position control plate 406 is vertically erected, the shaft H is moved in the direction indicated by the arrow −R7. In each of the states shown in FIG. 10(*o*1) and FIG. 10(*p*1), the conveyance plane is not moved in accordance with the movement of the shaft H, as described below. Thus, even when one or more of the packaged objects 110*a*, 110*b*, 110*c*, 110*d*, and 110*e* among the group of packaged objects 110 are lifted off the conveyance plane, the lifted packaged object is allowed to fall onto the conveyance plane due to the gravitational force, and the packaged objects 110*a*, 110*b*, 110*c*, 110*d*, and 110*e* among the group of packaged objects 110 are all controlled so as to be in the standing positions.

Figure 11:
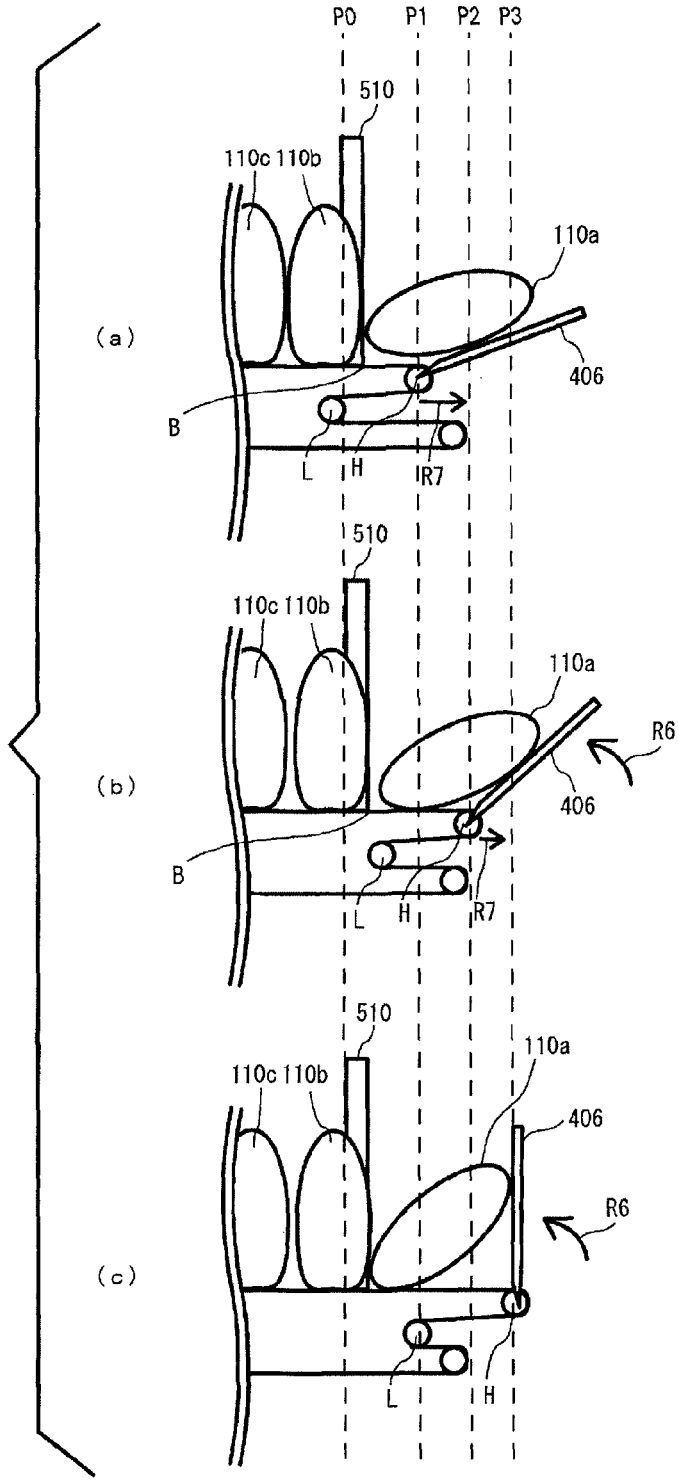
FIG. 11 is a schematic diagram illustrating operations performed by a second position control plate and the extendable conveyance unit.
Figure 12:
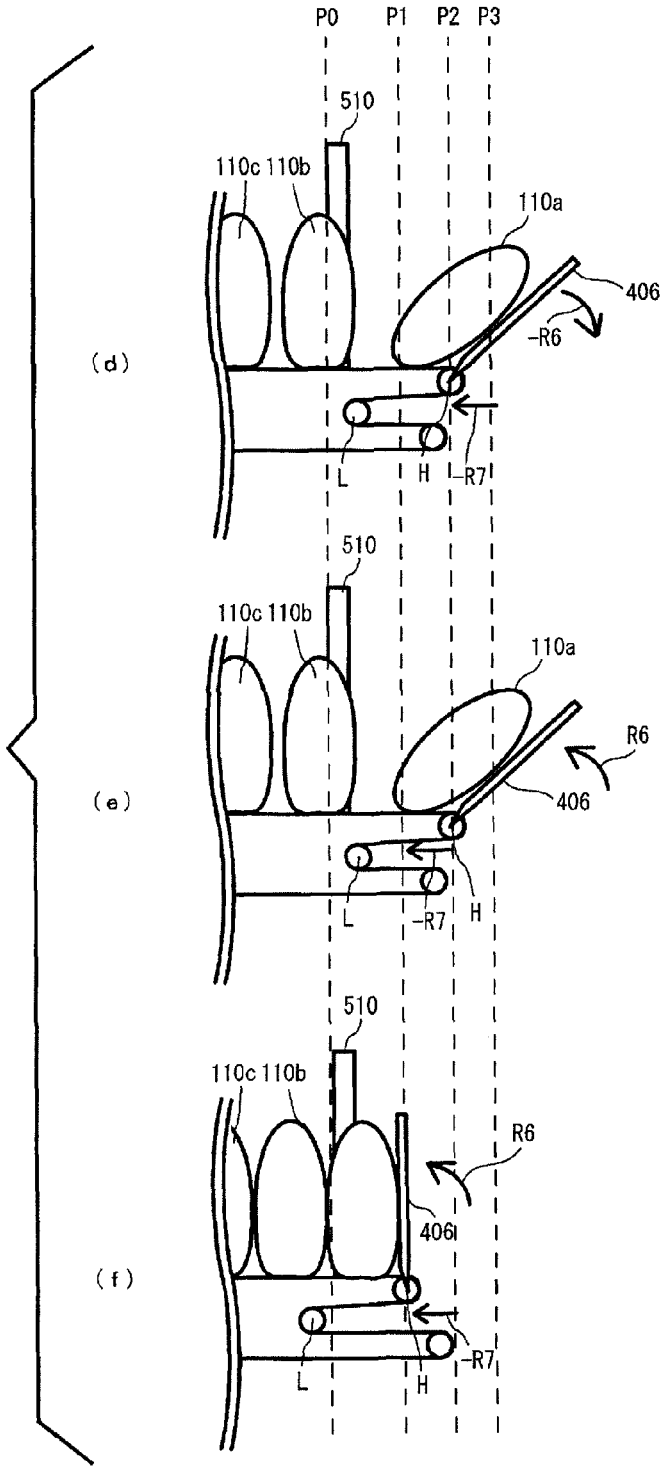
FIG. 12 is a schematic diagram illustrating operations performed by the second position control plate and the extendable conveyance unit.
Figure 13:
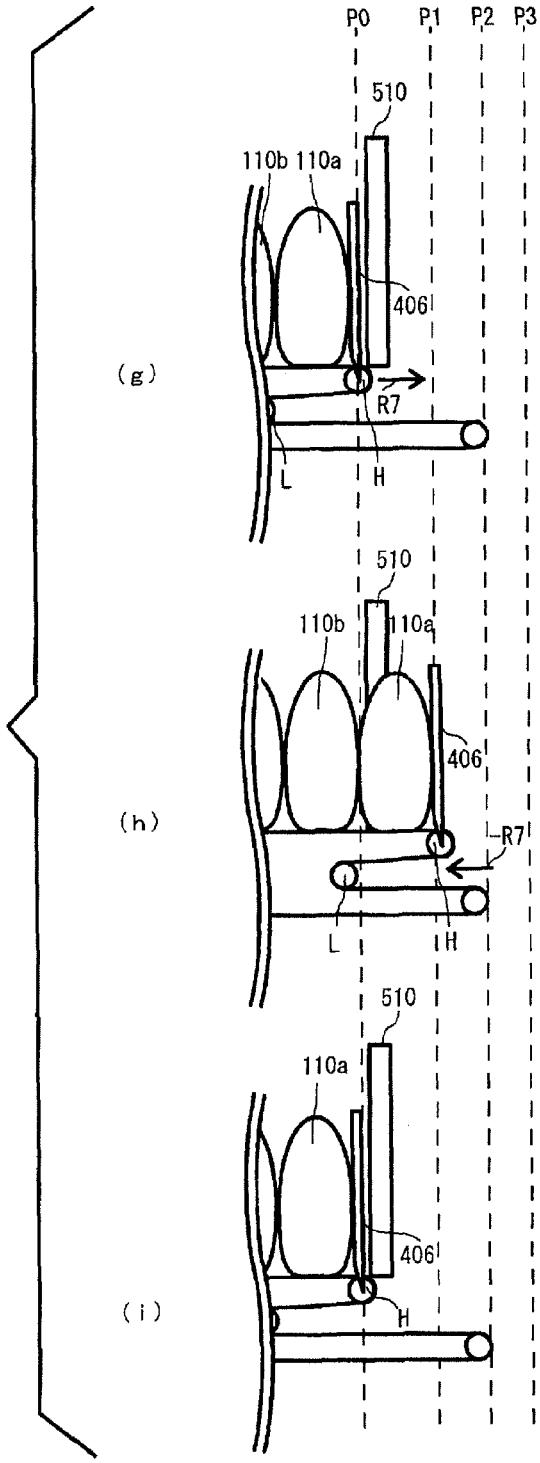
FIG. 13 is a schematic diagram illustrating operations performed by the second position control plate and the extendable conveyance unit.

Next, operations performed by the second position control plate 406 and the extendable conveyance unit 420 will be described with reference to FIG. 11 to FIG. 13. FIG. 11 to FIG. 13 are schematic diagrams illustrating operations performed by the second position control plate 406 and the extendable conveyance unit 420. A position P0 is a position at which the second position control plate 406 is to be positioned in order to deliver the group of packaged objects 110 to the subsequent process step.

Firstly, as shown in FIG. 11(*a*), when the second position control plate 406 is waiting for the group of packaged objects 110, the shaft H of the second position control plate 406 is positioned at a position P1. When the packaged object 110*a* is loaded on the second position control plate 406, the shaft H of the second position control plate 406 is moved in the direction indicated by the arrow R7. Similarly, the shaft L is moved in the direction indicated by the arrow R7.

Subsequently, as shown in FIG. 11(*b*), when the shaft H of the second position control plate 406 has been moved to a position P2, the second position control plate 406 starts to be rotated about the shaft H of the second position control plate 406 in the direction indicated by the arrow R6. Further, the shaft H of the second position control plate 406 continues to be moved in the direction indicated by the arrow R7 to reach a position P3. In this case, as shown in FIG. 11(*a*) and FIG. 11(*b*), a point B on the conveyance plane is not moved, and is located at the same position.

Further, as shown in FIG. 11(*c*), the second position control plate 406 is further rotated about the shaft H of the second position control plate 406 in the direction indicated by the arrow R6 until the second position control plate 406 is erected.

Subsequently, as shown in FIG. 12(*d*), while the second position control plate 406 is being rotated about the shaft H of the second position control plate 406 in the direction (the direction opposite to the direction indicated by the arrow R6) indicated by the arrow −R6, the shaft H of the second position control plate 406 is moved in the direction (the direction opposite to the direction indicated by the arrow R7) indicated by the arrow −R7 to reach the position P2.

Further, as shown in FIG. 12(*e*), the second position control plate 406 starts to be rotated about the shaft H of the second position control plate 406 in the direction indicated by the arrow R6, and the shaft H of the second position control plate 406 is simultaneously moved in the direction (the direction opposite to the direction indicated by the arrow R7) indicated by the arrow −R7, toward the position P1. Consequently, as shown in FIG. 12(*f*), when the shaft H of the second position control plate 406 is moved to the position P1, the second position control plate 406 is erected. Subsequently, as shown in FIG. 13(*g*), in a state in which the second position control plate 406 is erected, the shaft H of the second position control plate 406 is moved in the direction indicated by the arrow −R7 to reach the position P0.

Lastly, as shown in FIG. 13(*g*), the shaft H of the second position control plate 406 is moved in the direction indicated by the arrow R7 to reach the position P1, and thereafter the shaft H of the second position control plate 406 is moved toward the position P0 in the direction indicated by the arrow −R7 as shown in FIG. 13(*h*), and the shaft H of the second position control plate 406 is moved in the direction indicated by the arrow −R7 to reach the position P0, as shown in FIG. 13(*i*).

In the first embodiment, the control for executing the operations shown in FIGS. 11(*a*), 11(*b*), 11(*c*), 12(*f*), and 13(*i*) is performed. The number of times each of the operations as shown in FIGS. 12(*d*) and 12(*e*) is performed may not necessarily be one. Each of the operations as shown in FIGS. 12(*d*) and 12(*e*) may be repeated multiple times. Further, the number of times each of the operations as shown in FIGS. 13(*g*), 13(*h*), and 13(*i*) is performed may not necessarily be one. Each of the operations as shown in FIGS. 13(*g*), 13(*h*), and 13(*i*) may be repeated multiple times.

Third Embodiment

Next, a packaging apparatus 100 according to a third embodiment will be described. Hereinafter, for the packaging apparatus 100 according to the third embodiment, components and operations different from those of the packaging apparatus 100 according to each of the first embodiment and the second embodiment will be mainly described.

Figure 14:
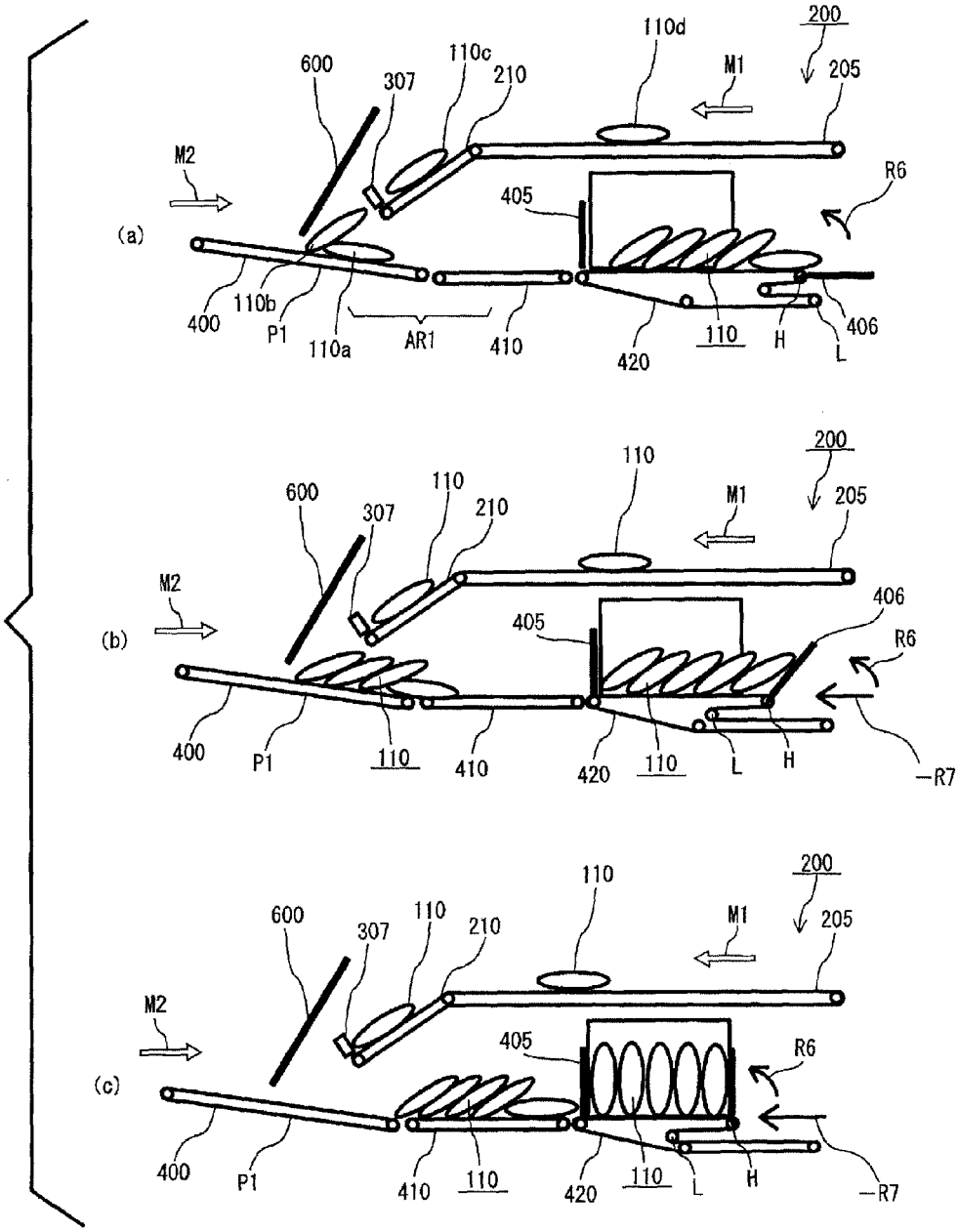
FIG. 14 is a schematic side view showing outlines of operations performed by a first conveyance unit, a second conveyance unit, a third conveyance unit, and an extendable conveyance unit of a packaging apparatus.

FIG. 14 is a schematic side view illustrating outlines of operations performed by a first conveyance unit 200, a second conveyance unit 400, a third conveyance unit 410, and an extendable conveyance unit 420 of the packaging apparatus 100.

The packaging apparatus 100 according to the third embodiment controls a second position control plate 406 in a manner different from the packaging apparatus 100 according to each of the first embodiment and the second embodiment.

As shown in FIG. 14(*a*), in the packaging apparatus 100 according to the third embodiment, the second position control plate 406 which is horizontally positioned waits for a predetermined number of packaged objects 110. Further, unlike in the first and the second embodiments, in the third embodiment, the packaged objects 110 each having a reduced thickness are handled, and the predetermined number of packaged objects 110 which are partially overlaid on adjacent packaged objects are conveyed.

Subsequently, as shown in FIG. 14(*b*), a shaft H of the extendable conveyance unit 420 is moved in the direction indicated by an arrow −R7, and the second position control plate 406 simultaneously starts to be rotated in the direction indicated by an arrow R6. At this time, a shaft L of the extendable conveyance unit 420 is moved in the direction indicated by the arrow −R7.

Thus, the predetermined number of the packaged objects 110 are supported by the second position control plate 406, and approach the standing positions.

Subsequently, as shown in FIG. 14(*c*), while the shaft H of the extendable conveyance unit 420 is being further moved in the direction indicated by the arrow −R7, the second position control plate 406 is further rotated in the direction indicated by the arrow R6. In this case, the shaft L of the extendable conveyance unit 420 is further moved in the direction indicated by the arrow −R7. The predetermined number of the packaged objects 110 are supported by the second position control plate 406, and enter the standing positions.

Figure 15:
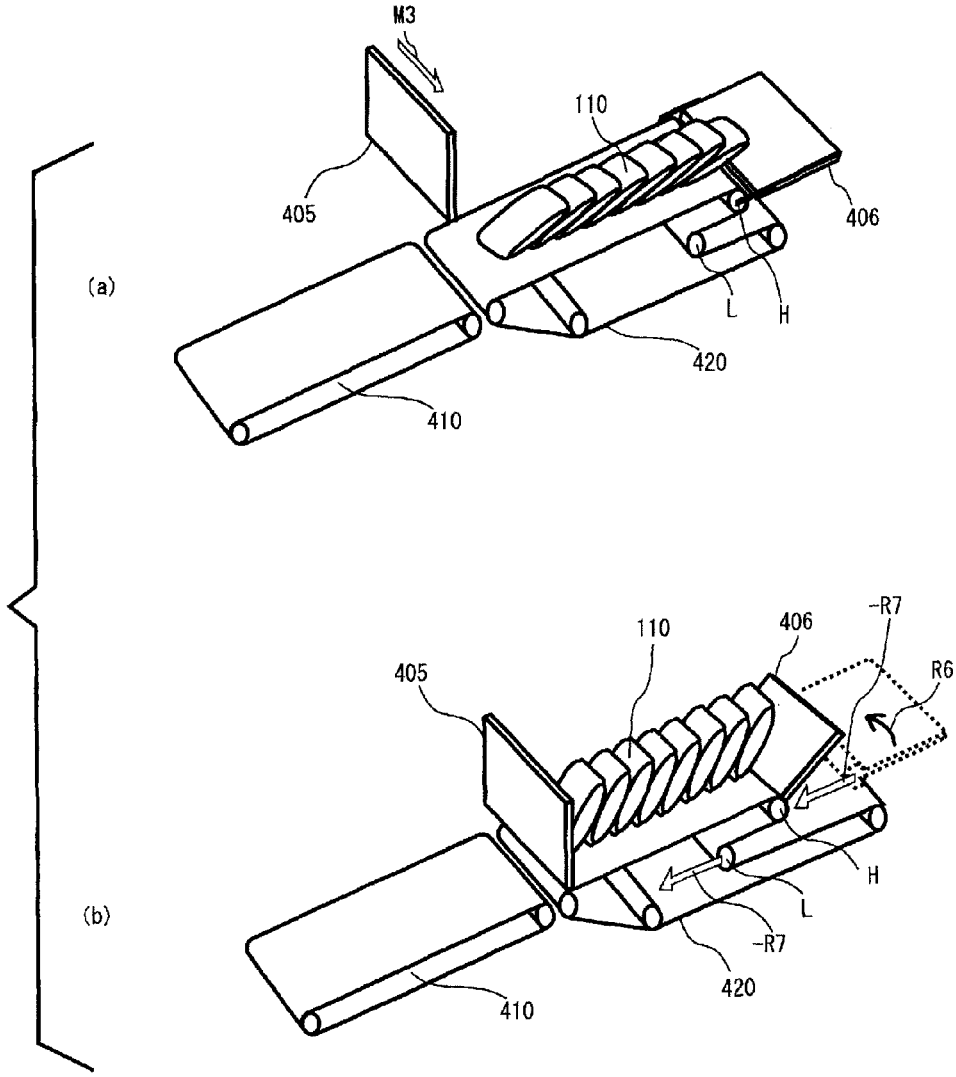
FIG. 15 is a schematic perspective view illustrating in detail exemplary operations performed by a first position control plate, a second position control plate, and a third position control plate of the extendable conveyance unit.
Figure 16:
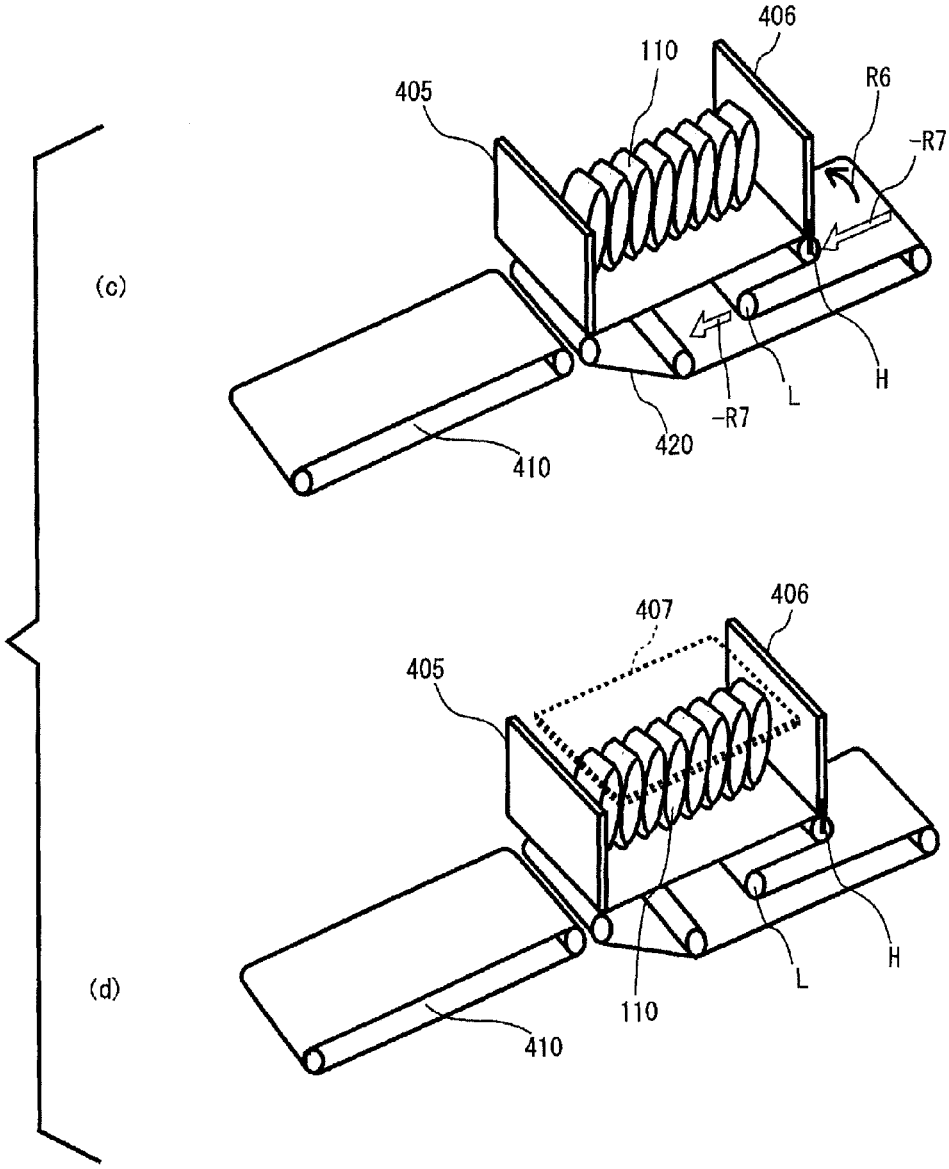
FIG. 16 is a schematic perspective view illustrating in detail the exemplary operations performed by the first position control plate, the second position control plate, and the third position control plate of the extendable conveyance unit.
Figure 17:
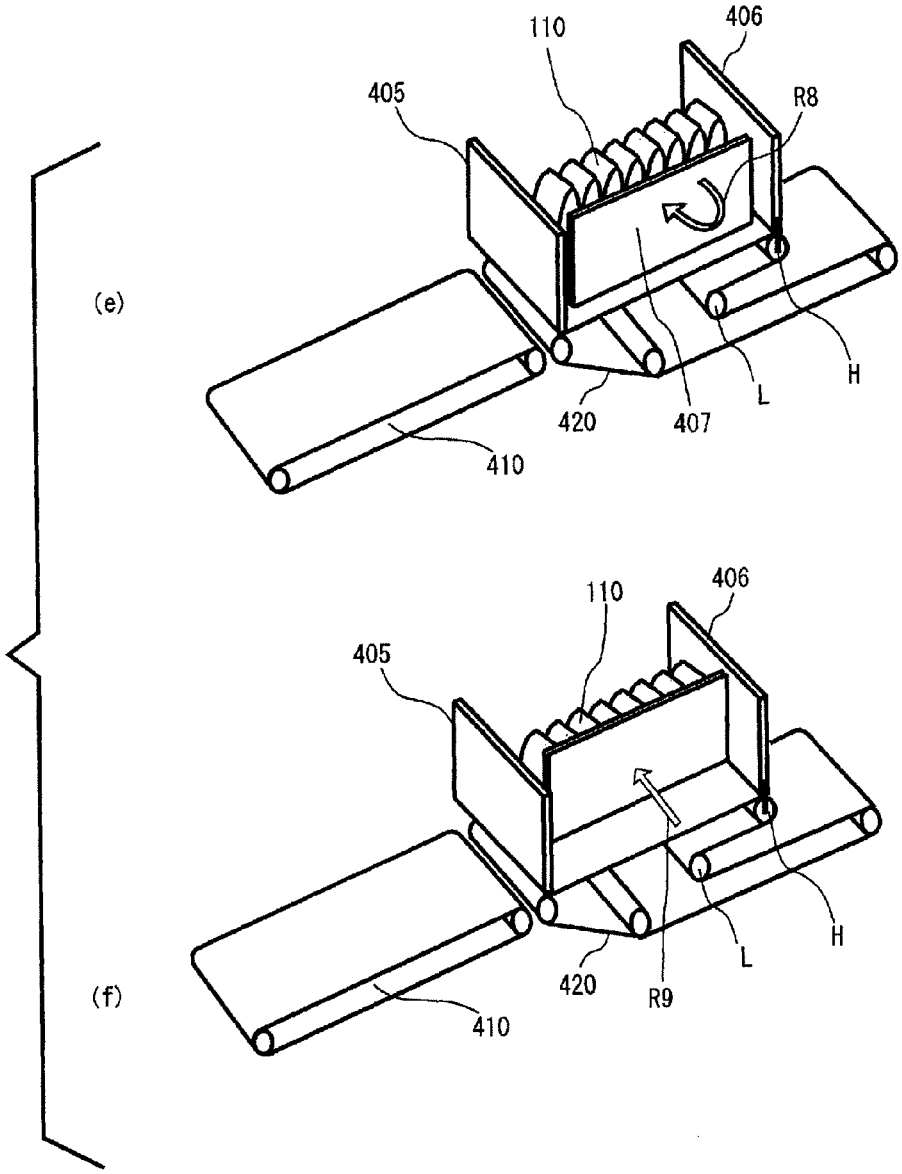
FIG. 17 is a schematic perspective view illustrating in detail the exemplary operations performed by the first position control plate, the second position control plate, and the third position control plate of the extendable conveyance unit.

Next, FIG. 15 to FIG. 17 are schematic perspective views illustrating in detail exemplary operations performed by a first position control plate 405, the second position control plate 406, and a third position control plate 407 in the extendable conveyance unit 420.

As shown in FIG. 15(*a*), when the predetermined number of the packaged objects 110 are conveyed to the downstream-side portion of the extendable conveyance unit 420, and all of the packaged objects 110 have passed the vicinity of the first position control plate 405, the first position control plate 405 is moved in the direction indicated by an arrow M3. Further, as shown in FIG. 15(*a*), the predetermined number of the packaged objects 110 are conveyed, and about half the length of the foremost one of the packaged objects 110 is loaded on the second position control plate 406. In this case, as shown in FIG. 15(*b*), the extendable conveyance unit 420 is driven so as to stop operating, and the shaft H corresponding to the rotation axis for the second position control plate 406 is moved in the direction indicated by the arrow −R7, and the second position control plate 406 is simultaneously rotated in the direction indicated by the arrow R6. Thus, the packaged objects 110 can be caused to approach the standing positions in a reduced time period. Further, the flexure of the belt conveyor having the shaft H moved in the direction indicated by the arrow −R7 can be absorbed by moving the shaft L of the extendable conveyance unit 420 in the direction indicated by the arrow −R7.

Subsequently, as shown in FIG. 16(*c*), the second position control plate 406 is rotated and the shaft H is moved until the second position control plate 406 is erected, so that the predetermined number of the packaged objects 110 enter the standing positions. The second position control plate 406 may be further rotated in the direction (the direction indicated by the arrow R6) toward the first position control plate 405. Thus, the packaged objects 110 can assuredly enter the standing positions.

Further, as shown in FIG. 16(*d*), the third position control plate 407 is positioned thereabove. Subsequently, as shown in FIG. 17(*e*), the third position control plate 407 is rotated in the direction indicated by an arrow R8 to be positioned along the side portions of the predetermined number of the packaged objects 110 which are in the standing positions.

Lastly, as shown in FIG. 17(*f*), the third position control plate 407 is slid in the direction indicated by an arrow R9, and the predetermined number of the packaged objects 110 which are in the standing positions are conveyed toward the box 500, and put into the box 500.

Figure 18:
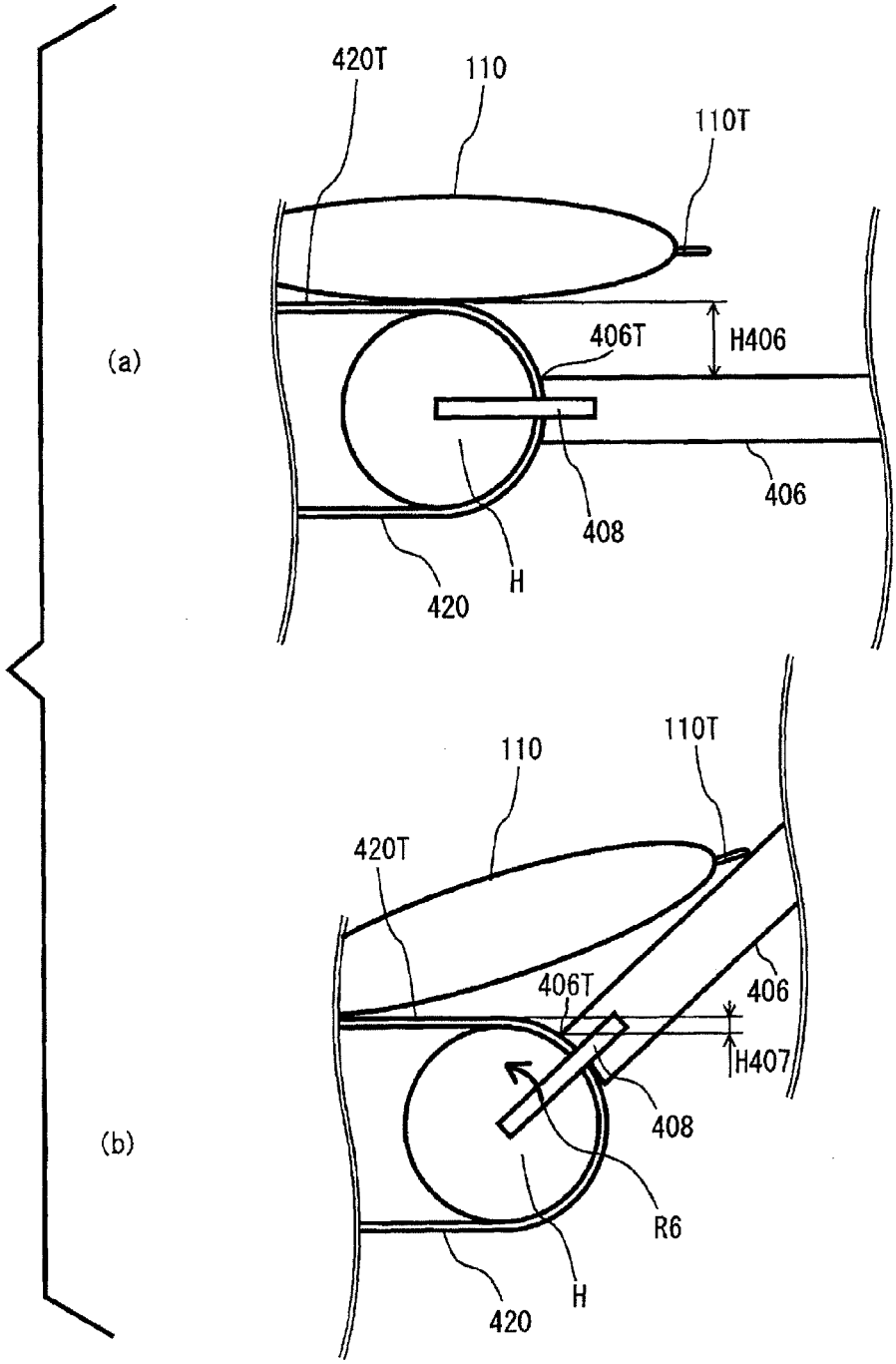
FIG. 18 is a schematic perspective view illustrating in detail the exemplary operations performed by the first position control plate, the second position control plate, and the third position control plate of the extendable conveyance unit.

Next, FIG. 18 is a schematic diagram illustrating structures of the second position control plate 406 and the shaft H. FIG. 18(*a*) shows a state in which the second position control plate 406 has not been rotated yet, and FIG. 18(*b*) shows a state in which the second position control plate 406 is being rotated.

As shown in FIG. 18(*a*), the second position control plate 406 is secured to the shaft H by means of a securing component 408. Further, as shown in FIG. 18(*a*), an end edge 406T of the second position control plate 406 is provided vertically below a conveyance plane 420T of the extendable conveyance unit 420 such that the difference in height between the end edge 406T and the conveyance plane 420T is a distance H406. In this case, when the packaged objects 110 are conveyed, a head portion 110T of the packaged objects 110 is prevented from being inserted into a clearance between the end edge 406T of the second position control plate 406 and the conveyance plane 420T of the extendable conveyance unit 420.

Further, as shown in FIG. 18(*b*), the securing component 408 is rotated in the direction indicated by the arrow R6, so that the second position control plate 406 is rotated in the direction indicated by the arrow R6. Also in this case, the end edge 406T of the second position control plate 406 is provided vertically below the conveyance plane 420T of the extendable conveyance unit 420 such that the difference in height between the end edge 406T and the conveyance plane 420T is a distance H407. Therefore, the head portion 110T of the packaged objects 110 is prevented from being inserted into the clearance between the end edge 406T of the second position control plate 406 and the conveyance plane 420T of the extendable conveyance unit 420.

In the present embodiment, the packaged objects 110 are awaited in the state shown in FIG. 18(*a*). However, the present invention is not limited thereto. The packaged objects 110 may be awaited in the state shown in FIG. 18(*b*). In this case, the end edge 406T is provided vertically below the conveyance plane 420T such that the difference in height between the end edge 406T and the conveyance plane 420T is the distance H407. Therefore, the head portion 110T of the packaged objects 110 is prevented from being inserted into the clearance between the end edge 406T of the second position control plate 406 and the conveyance plane 420T of the extendable conveyance unit 420.

ANOTHER EXAMPLE

Figure 19:
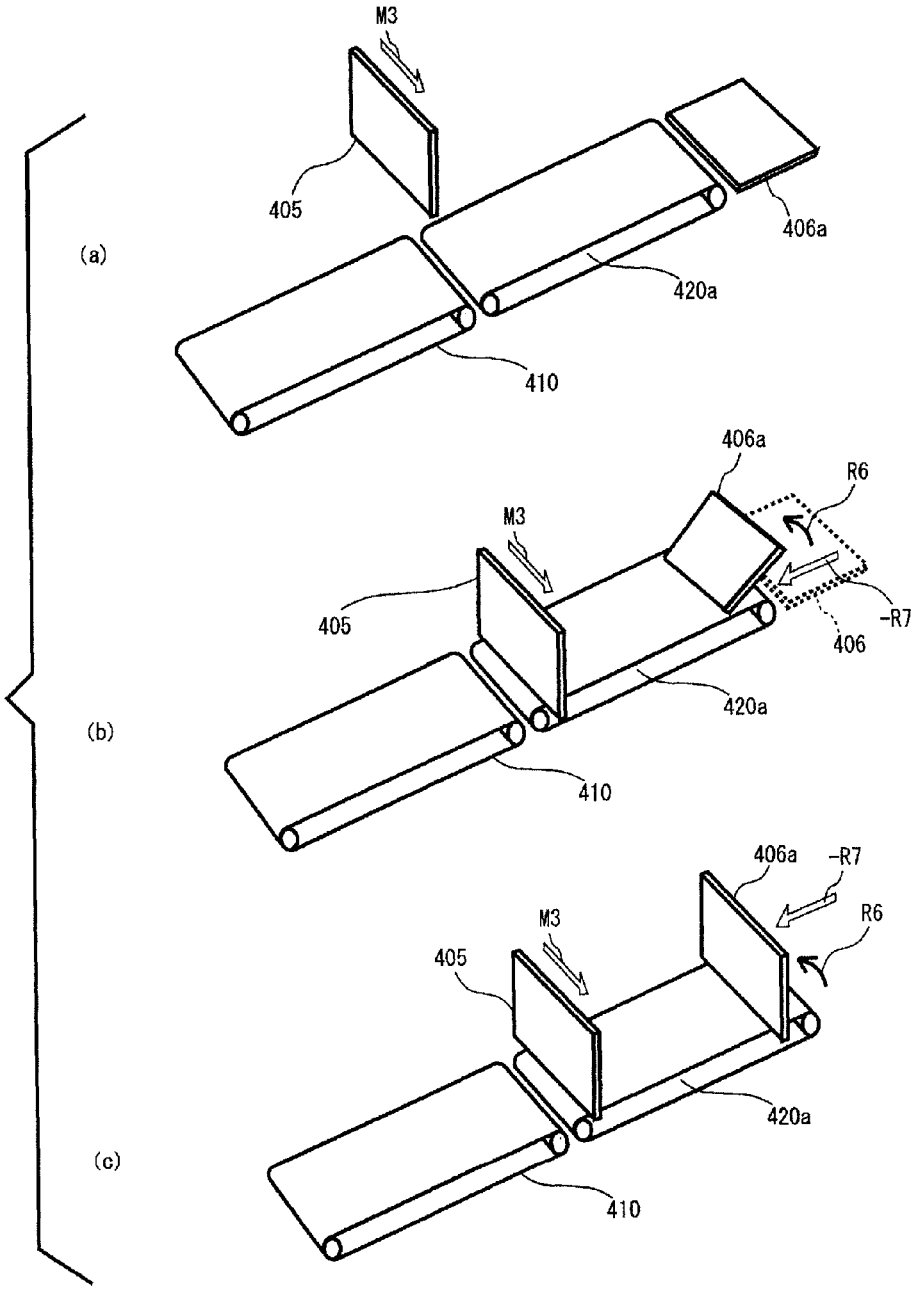
FIG. 19 is a schematic perspective view illustrating another exemplary operation performed a second position control plate of an extendable conveyance unit.

Next, FIG. 19 is a schematic perspective view illustrating other exemplary operations performed by an extendable conveyance unit 420 and a second position control plate 406. In FIG. 19, the packaged objects 110 are not shown in order to clearly show an operation performed by a second position control plate 406*a*.

In the present embodiment, a fourth conveyance unit 420*a* formed as a standard belt conveyor is provided instead of the extendable conveyance unit 420. Further, the second position control plate 406*a* is operable to independently rotate (in the direction indicated by the arrow R6) and move (in the direction indicated by the arrow −R7). These operations are different from those of the second position control plate 406.

Firstly, when a predetermined number of packaged objects 110 are conveyed to the downstream-side portion of the fourth conveyance unit 420*a*, and all of the packaged objects 110 have passed the vicinity of the first position control plate 405, the first position control plate 405 is moved in the direction indicated by an arrow M3, as shown in FIG. 19(*a*). Further, the predetermined number of packaged objects 110 are conveyed, and about half the length of the foremost one of the packaged objects 110 is loaded on the second position control plate 406*a*. In this case, as shown in FIG. 19(*b*), the fourth conveyance unit 420*a* is driven so as to stop operating, and the second position control plate 406*a* is rotated in the direction indicated by the arrow R6, and is simultaneously moved in the direction indicated by the arrow −R7 on the fourth conveyance unit 420*a* in small increments. Thus, the packaged objects 110 can be caused to approach the standing positions in a reduced time period.

Subsequently, as shown in FIG. 19(*c*), the second position control plate 406*a* being rotated in the direction indicated by the arrow R6 so as to be erected is moved in the direction indicated by the arrow −R7, and the predetermined number of packaged objects 110 enter the standing positions. Thus, the predetermined number of packaged objects 110 which are in the standing positions are conveyed toward the box 500, and put into the box 500.

In the embodiment described above, the second position control plate 406, 406*a* is rotated in the direction indicated by the arrow R6, and is simultaneously moved in the direction indicated by the arrow −R7. However, the present invention is not limited thereto. The second position control plate 406, 406*a* may start to be moved in the direction indicated by the arrow −R7 at any time during a period from a time at which the second position control plate 406, 406*a* starts to be rotated in the direction indicated by the arrow R6 to a time at which the second position control plate 406, 406*a* is erected.

Further, the extendable conveyance unit 420 or the fourth conveyance unit 420*a* is stopped after the first position control plate 405 has been moved in the direction indicated by the arrow M3. However, the present invention is not limited thereto. After the first position control plate 405 has been moved in the direction indicated by the arrow M3, the extendable conveyance unit 420 or the fourth conveyance unit 420*a* may be rotated in a direction opposite to the conveying direction. In this case, the positions of the packaged objects 110 may be adjusted in a substantially reduced time period.

As described above, in the packaging apparatus 100 according to the present embodiment, the second conveyance unit 400, the third conveyance unit 410, and the extendable conveyance unit 420 are provided in order, respectively. Therefore, the plurality of packaged objects 110 are overlaid on adjacent packaged objects in the second conveyance unit 400, and are conveyed to the third conveyance unit 410. The second conveyance unit 400 is provided so as to be tilted at a predetermined angle $\alpha$2 relative to the horizontal plane, and the tilt of the second conveyance unit 400 prevents the positions of the packaged objects 110 from being misaligned during a period immediately after the second conveyance unit 400 starts to be driven.

Further, the positions of the packaged objects 110 are adjusted in the extendable conveyance unit 420. Further, a time period in which the positions of the packaged objects 110 are adjusted in the extendable conveyance unit 420 can be absorbed by using the third conveyance unit 410.

Furthermore, in the packaging apparatus 100, the control unit 301 performs a control so as to increase a relative distance between the shaft of the second position control plate 406 and the second packaged object 110*b* among the group of packaged objects 110 while erecting the second position control plate 406. Therefore, a space for allowing the position of the first packaged object 110*a* to be adjusted can be formed, and the second position control plate 406 is operable to adjust the position of the first packaged object 110*a*. Consequently, the group of packaged objects 110 can be conveyed in the standing position.

Moreover, even when the first packaged object 110*a* fails to enter the standing position, the second position control plate 406 is caused to approach the horizontal position, and lift and stand the first packaged object 110*a* again, so that the second position control plate 406 is operable to assuredly adjust the position of the first packaged object 110*a*. Consequently, the group of packaged objects 110 can be conveyed in the standing position.

In addition, the group of packaged objects 110 can be appropriately compressed or released by the distance between the shaft H of the second position control plate 406 and the second packaged object 110*b* being changed. Therefore, even when one or more of the packaged objects 110*a*, 110*b*, 110*c*, 110*d*, and 110*e* among the group of packaged objects 110 are lifted off the conveyance plane, the lifted packaged object can be allowed to contact the conveyance plane in the standing position by the group of packaged objects 110 being compressed or released.

Further, when the first position control plate 405 is moved so as to obstruct the movement of the packaged objects 110, the shaft H of the second position control plate 406, 406*a* is moved in the direction indicated by the arrow −R7 so as to retract the extendable conveyance unit, and the second position control plate 406, 406*a* is simultaneously rotated in the direction indicated by the arrow R6. Alternatively, after the shaft H of the second position control plate 406, 406*a* starts to be moved in the direction indicated by the arrow −R7 so as to retract the extendable conveyance unit, the second position control plate 406, 406*a* is rotated in the direction indicated by the arrow R6. Thus, the positions of the packaged objects 110 can be adjusted in a reduced time period.

Components of the present invention satisfy the following correspondences. The packaging apparatus 100 corresponds to a packaging apparatus. The plurality of packaged objects 110*a*, 110*b*, 110*c*, 110*d*, and 110*e* correspond to a plurality of packaged objects. The group of packaged objects 110 corresponds to a group of packaged objects. The packaged object 110*a* corresponds to a first packaged object. The packaged object 110*b* corresponds to a second packaged object. The tilt unit 210 corresponds to a tilt unit. At least one of the first conveyance unit 200, the second conveyance unit 400, the third conveyance unit 410, the extendable conveyance unit 420, and the fourth conveyance unit 420*a* corresponds to a conveyance unit. The second conveyance unit 400, the third conveyance unit 410, the extendable conveyance unit 420, and the fourth conveyance unit 420*a* correspond to a second conveyance unit. The second conveyance unit 400 corresponds to a tilt conveyance unit. The third conveyance unit 410 corresponds to a stock conveyance unit. The fourth conveyance unit 420*a* corresponds to a conveyance unit. The control unit 301 corresponds to a control unit. The shaft H corresponds to a shaft of the second position control plate 406. "Rotated in the direction indicated by the arrow R6" corresponds to "the second position control plate is rotated to be erected". The control shown in FIG. 10 corresponds to "perform a control such that a distance between the shaft of the second position control plate and the second packaged object is changed". The extendable conveyance unit 420 corresponds to a conveyance unit, a shuttle conveyor, and an extendable belt conveyor. The second conveyance unit 400 and the third conveyance unit 410 correspond to a reception conveyance unit. The first position control plate 405 corresponds to a first position control plate. The second position control plate 406, 406*a* corresponds to a second position control plate and a plate component. The third position control plate 407 corresponds to a subsequent process step delivery unit. The direction indicated by the arrow −R7 corresponds to a direction "from a downstream-side portion of the conveyance unit toward the first position control plate". The end edge 406T of the second position control plate 406 shown in FIG. 10(*a*) corresponds to a pivotally supported end edge of the plate component. The conveyance plane 420T of the belt conveyor corresponding to the upper portion of the extendable conveyance unit 420 corresponds to a conveyance plane of the extendable belt conveyor. The distance H406 corresponds to a distance between the end edge of the plate component and the conveyance plane of the extendable belt conveyor. The shaft H corresponds to a downstream-side end edge portion of the extendable belt conveyor.

While a preferred embodiment of the present invention has been described above, the present invention is not limited thereto. It should be understood that other various embodiments may be devised without departing from the spirit and the scope of the present invention. Further, actions and effects obtained from the features of the preferred embodiment of the present invention are illustrative and not restrictive.

What is claimed is:

1. A packaging apparatus comprising:

a collection unit configured and arranged to overlay a plurality of packaged objects on adjacent packaged objects; and a conveyance unit configured and arranged to convey, as a group of packaged objects, the packaged objects which are overlaid on the adjacent packaged objects at the collection unit, the conveyance unit including a belt conveyor, a first position control plate, a second position control plate, and a subsequent process step delivery unit, the first position control plate being configured and arranged to selectively move forward or backward so as to obstruct or pass the group of packaged objects conveyed on the belt conveyor, when positions of the packaged objects in the group of packaged objects are adjusted, the second position control plate being configured and arranged to move from a downstream-side portion of the belt conveyor toward the first position control plate, rotate in a direction toward the first position control plate, or move from the downstream-side portion of the belt conveyor toward the first position control plate and simultaneously rotate in the direction toward the first position control plate, and the subsequent process step delivery unit being configured and arranged to deliver the group of packaged objects after the positions of the packaged objects are adjusted by the first position control plate and the second position control plate, to a subsequent process device that packs the group of packaged objects in a box.

2. The packaging apparatus according to claim 1, wherein, the second position control includes a plate component that is pivotally supported by the belt conveyor at a downstream-side end edge portion of the belt conveyor, and pivots about the downstream-side end edge portion of the belt conveyor when the extendable belt conveyor is extended or retracted.

3. The packaging apparatus according to claim 2, wherein the second position control plate is configured such that, before the packaged objects are aligned, a pivotally supported end edge of the plate component is positioned vertically below a conveyance plane of the belt conveyor.

4. The packaging apparatus according to claim 1, further comprising a control unit configured to control the conveyance unit and the second position control plate, the second position control plate being pivotally supported at a downstream-side portion of the conveyance unit to adjust positions of the packaged objects, and the control unit being configured to control the conveyance unit to increase a relative distance between a shaft of the second position control plate and a second packaged object among the group of packaged objects from a front side with respect to a conveying direction while erecting the second position control plate.

5. The packaging apparatus according to claim 4, wherein the control unit is configured to control the conveyance unit to increase the relative distance between the shaft of the second position control plate and the second packaged object among the group of packaged objects by moving the shaft of the second position control plate toward the downstream-side portion of the conveyance unit.

6. The packaging apparatus according to claim 4, wherein the control unit is configured to control the conveyance unit to increase the relative distance between the shaft of the second position control plate and the second packaged object among the group of packaged objects by moving a conveyance plane of the conveyance unit in a direction opposite to the conveying direction in which the group of packaged objects is conveyed.

7. The packaging apparatus according to claim 4, wherein the control unit is configured to control the conveyance unit such that the shaft of the second position control plate is moved close to the second packaged object among the group of packaged objects while the second position control plate is approaching a horizontal position, and thereafter the second position control plate is rotated to be erected.

8. The packaging apparatus according to claim 4, wherein the control unit is configured to control the conveyance unit such that the second position control plate is rotated so as to be erected while the shaft of the second position control plate is being moved toward an upstream side.

9. The packaging apparatus according to claim 4, wherein the control unit is configured to control the conveyance unit such that a distance between the shaft of the second position control plate and the second packaged object is changed so as to maintain the second position control plate erected.

10. The packaging apparatus according to claim 4, wherein the control unit configured to control the conveyance unit to move the second position control plate while the second position control plate waits for the group of packaged objects being conveyed such that the greater a distance from a downstream end edge of the conveyance unit to the first position control plate is, the more upwardly the second position control plate is tilted relative to a conveyance plane.

11. The packaging apparatus according to claim 4, wherein the first position control plate is configured and arranged to selectively move forward or backward in a direction orthogonal to the conveying direction in which the conveyance unit conveys the group of packaged objects, so as to obstruct or pass the group of packaged objects being conveyed, and the control unit is configured to control the conveyance unit such that the group of packaged objects passes the first position control plate, and, after the group of packaged objects has passed the first position control plate, the control unit is configured to control the first position control plate so as to move forward such that a force is applied to the group of packaged objects, from both the conveying direction and a direction opposite to the conveying direction, by both the first position control plate and the second position control plate.

12. The packaging apparatus according to claim 4, wherein the belt conveyor is extendable at a downstream-side end portion thereof along the conveying direction in which the group of packaged objects are conveyed, and the shaft of the second position control plate is provided at the downstream-side end portion of the belt conveyor which is extendable.

* * * * *